US007754030B2

(12) United States Patent
Okitsu

(10) Patent No.: US 7,754,030 B2
(45) Date of Patent: Jul. 13, 2010

(54) HIGH STRENGTH STEEL SHEET AND METHOD FOR PRODUCTION THEREOF

(75) Inventor: Yoshitaka Okitsu, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 483 days.

(21) Appl. No.: 11/792,090

(22) PCT Filed: Nov. 30, 2005

(86) PCT No.: PCT/JP2005/022008

§ 371 (c)(1),
(2), (4) Date: Jun. 1, 2007

(87) PCT Pub. No.: WO2006/059653

PCT Pub. Date: Jun. 8, 2006

(65) Prior Publication Data

US 2008/0131305 A1 Jun. 5, 2008

(30) Foreign Application Priority Data

Dec. 3, 2004 (JP) ..... 2004-351139

(51) Int. Cl.

| | |
|---|---|
| ***C22C 38/02*** | (2006.01) |
| ***C22C 38/04*** | (2006.01) |
| ***C22C 38/18*** | (2006.01) |
| ***C22C 38/40*** | (2006.01) |
| ***C21D 8/00*** | (2006.01) |

(52) U.S. Cl. ..... 148/320; 148/330; 148/332; 148/334; 148/335; 148/336; 148/603; 148/651

(58) Field of Classification Search ..... 148/320, 148/330, 333–336, 603, 651, 652
See application file for complete search history.

(56) References Cited

U.S. PATENT DOCUMENTS

| | | | | |
|---|---|---|---|---|
| 6,221,179 | B1 | 4/2001 | Yasuhara et al. | |
| 6,589,369 | B2 | 7/2003 | Yokoi et al. | |
| 6,638,371 | B1 * | 10/2003 | Mochida et al. | 148/320 |
| 6,962,631 | B2 | 11/2005 | Sugiura et al. | |
| 2004/0112484 | A1 | 6/2004 | Saito et al. | |

FOREIGN PATENT DOCUMENTS

| | | | |
|---|---|---|---|
| EP | 0 945 522 | A1 | 9/1999 |
| JP | 10-147838 | A | 6/1998 |

(Continued)

OTHER PUBLICATIONS

Heinrich Ruhfus, "Thermal Treatment of Iron-Materials", Stahleisen LTD, Dusseldolf, 1958, pp. 70-73 and 91.

*Primary Examiner*—Deborah Yee
(74) *Attorney, Agent, or Firm*—Arent Fox LLP

(57) ABSTRACT

A high-strength steel sheet has a metal structure consisting of a ferrite phase in which a hard second phase is dispersed and has 3 to 30% of an area ratio of the hard second phase. In the ferrite phase, the area ratio of nanograins of which grain sizes are not more than 1.2 μm is 15 to 90%, and dS as an average grain size of nanograins of which grain sizes are not more than 1.2 μm and dL as an average grain size of micrograins of which grain sizes are more than 1.2 μm satisfy an equation (dL/dS≧3).

9 Claims, 8 Drawing Sheets

FOREIGN PATENT DOCUMENTS

| | | | |
|---|---|---|---|
| JP | 11-152544 | A | 6/1999 |
| JP | 2002-053935 | A | 2/2002 |
| JP | 2002-073152 | | 3/2002 |
| JP | 2002-97545 | A | 4/2002 |
| JP | 2002-256390 | A | 9/2002 |
| JP | 2002-285278 | A | 10/2002 |

* cited by examiner

Fig. 1

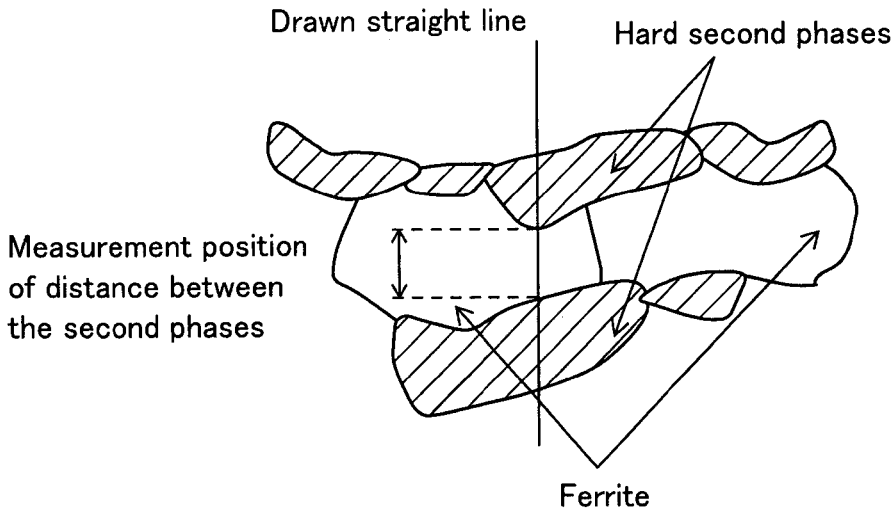

Fig. 2

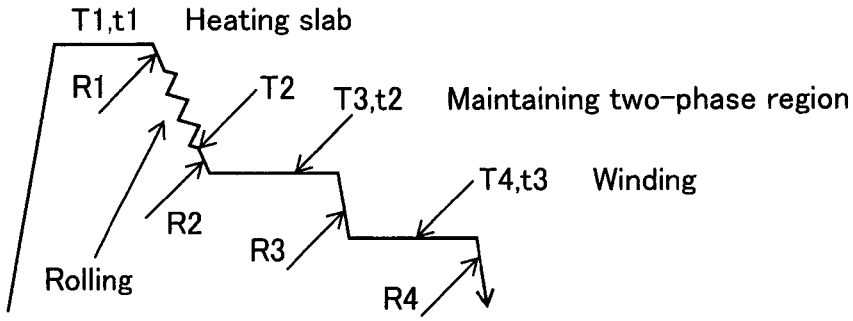

| | |
|---|---|
| T1 | Temperature of heating slab |
| t1 | Time of heating slab |
| R1 | Cooling rate before rolling |
| T2 | Starting temperature of rapid cooling |
| R2 | Cooling rate before maintaining temperature |
| T3 | Maintaining temperature |
| t2 | Maintaining time |
| R3 | Cooling rate before winding temperature |
| T4 | Winding temperature |
| t3 | Maintaining time at winding temperature |
| R4 | Cooling rate before room temperature |

| | |
|---|---|
| $T_S$ | Annealing temperature |
| $t_S$ | Annealing time |
| $T_Q$ | Starting temperature of rapid cooling |
| $R_C$ | Cooling rate |
| $T_{OA}$ | Overaging temperature |
| $t_{OA}$ | Overaging time |

HIGH STRENGTH STEEL SHEET AND METHOD FOR PRODUCTION THEREOF

CROSS-REFERENCE TO RELATED APPLICATION

This application is a National Stage entry of International Application No. PCT/JP2005/022008, filed Nov. 30, 2005, the entire specification claims and drawings of which are incorporated herewith by reference.

TECHNICAL FIELD

The present invention relates to high-strength steel sheets and to production methods therefor, and specifically relates to a production technique for high-strength steel sheets for automobiles, which have high strength with fast deformation, high absorption characteristics of impact energy, and high workability.

BACKGROUND ART

High-strength steel sheets are used for bodies of automobiles, and techniques relating to these kinds of steel sheets are mentioned below. Japanese Unexamined Patent Application Publication No. 2002-97545 discloses a steel sheet with high-workability and high-strength having superior shape-retaining properties in machining processing and absorption properties for impact energy. A steel sheet of a specified composition has a complex structure including a residual austenite which is not less than 3% by volume, an average ratio of X-ray random reinforcement of the orientation group {1 0 0}<0 1 1> to {2 2 3}<1 0 0> on at least an area at a depth of ½ sheet thickness from the surface is not less than 3.0, an average ratio of X-ray random reinforcement of three crystal orientations {5 5 4}<2 2 5>, {1 1 1}<1 1 2> and {1 1 1}<1 1 0> is not more than 3.5, and at least one plastic strain ratio in the directions which are a rolling direction and a direction perpendicular to the rolling direction is not more than 0.7.

Japanese Unexamined Patent Application Publication No. 10-147838 discloses a high-strength steel sheet consisting of 0.05 to 0.20 wt % of C, 2.0 wt % or less of Si, 0.3 to 3.0 wt % of Mn, 0.1 wt % or less of P, 0.1 wt % or less of Al, and the balance of Fe and inevitable impurities. The steel sheet has two phase structures of a martensitic phase and the balance of a ferrite phase. Volume rate of the martensitic phase is 5 to 30%, and a ratio Hv (M)/Hv (F) in which Hv (M) is hardness of martensitic phase and Hv (F) is hardness of ferrite phase, is 3.0 to 4.5.

Japanese Unexamined Patent Application Publication No. 2000-73152 discloses a production method for high-strength metal sheets comprising an ultrafine structure that is refined to an average grain size of not more than 1 μm by repeating plural cycles of the following processes. The processes includes a step for laminating plural metal sheets, of which the surface is cleaned, and connecting the edges thereof, a step for heating the laminated sheets having connected edges in a range of a recovery temperature and below a recrystallizing temperature, a step for rolling and connecting the heated laminated sheets into a predetermined sheet thickness, and a step for cutting the laminated sheets which are connected by rolling into a predetermined length in a longitudinal direction, thereby making plural metal sheets, and cleaning surfaces thereof.

Japanese Unexamined Patent Application Publication No. 2002-285278 discloses a low-carbon steel with high-strength and high-ductility having properties in which the tensile strength is not less than 800 MPa, the average elongation is not less than 5%, and the elongation is not less than 20%. Such a steel may be obtained by the following processes. A plain low-carbon steel or a plain low-carbon steel with not more than 0.01% of boron in a range which is an effective amount for accelerating martensitic transformation is processed and heated. Then, the steel having not less than 90% of a martensitic phase, which is obtained by water-cooling after coarsening the austenite grains, is worked under low strain. Specifically, the steel is subjected to cold rolling at an overall reduction rate of 20% or more, but less than 80%, and low-temperature annealing at a temperature of 500 to 600° C., thereby obtaining an average grain size of a ferrite structure of ultrafine grains which is not more than 1.0 μm.

Generally, increasing the strength of the steel sheet for automobile bodies and improving the absorption characteristics of impact energy are effective to protecting occupants from the impact of automobile crashes. However, when the strength of the steel sheet is simply increased, the workability decreases and the press forming is difficult to perform. Therefore, both the press formability and the impact energy absorption properties are generally improved by increasing the difference of static and dynamic stresses which are generated in the static deformation corresponding to the press forming and are generated in the dynamic deformation corresponding to the impact.

That is, the above Japanese Unexamined Patent Application Publication No. 2002-97545 proposes a steel sheet comprising a complex structure of ferrite and residual austenite as a steel sheet with a large difference of static and dynamic stresses. According to the technique shown in the above reference (p. 13, Table 2), for example, a steel sheet in which the stress of the static deformation is 784 MPa and the difference of static and dynamic stresses is 127 MPa may be obtained. However, the difference of static and dynamic stresses are lower than that of mild steel sheets. Conventionally, a high-strength steel sheet in which stress of the static deformation exceeds 500 MPa was impossible to have difference of static and dynamic stresses of not less than 170 MPa, which corresponds to that of mild steel sheets.

The reason for this is explained below. A large number of alloying elements needed to be added to a mild steel sheet as a raw material, in order to increase the strength by conventional methods, that is, solid solution strengthening, precipitation strengthening, complex structure strengthening, and quench strengthening. Therefore, the purity of the ferrite is low when the series of the methods are applied. The difference of static and dynamic stresses of the ferrite depends on a thermal component generated by thermal oscillation of atoms, which is a portion of the potential amount required for movement of dislocation. The dependence of the strain rate of the deformation stress increases when the thermal component is large. However, the dependence of the strain rate of the deformation stress decreases when the thermal component is small due to the low purity of the ferrite. Therefore, the decrease of the difference of static and dynamic stresses was inevitable when the steel was strengthened by the conventional methods.

In the above Japanese Unexamined Patent Application Publication No. 10-147838, a steel with a complex structure of ferrite and martensite may be strengthened by controlling the amount of solid-solved carbon, which process corresponds to baking painting (2% of pre-strain and heat treatment at 170° C. for 20 minutes). However, the strength is difficult to improve when draw forming is changed to bending forming to simplify the press processes, because the strengths of portions that are not strained are not changed by the method. Moreover, in recent years, baking painting has been performed at lower temperatures and for shorter times, and the above expected effect is difficult to obtain. Therefore, development of steel sheets that have excellent impact energy absorption properties without baking painting has been required.

Under these circumstances, a refinement of ferrite grains is focused on as a method for strengthening steels, which is independent of the above conventional methods. That is, the method is used for strengthening the steel by controlling the addition of alloying elements as little as possible, not by adding alloying elements, but by enlarging the area of grain boundaries, and refining the grains maintaining the high purity of ferrite. The outline of function of the method is that the strain rate of the deformation stress is independent of the grain size, which is measured on the basis that a migratory distance required for one shift of a Peierls potential is independent of the grain size.

The relationship between the grain size and the strength is known from the Hall-Petch equation, and the strength against deformation is proportional to −½ the power of the grain size. According to the equation, the strength is considerably increased when the grain size is less than 1 μm, for example, the strength of the steel when the grain sizes are 1 μm is at least 3 times higher than that of the steel when the grain sizes are 10 μm.

The above Japanese Unexamined Patent Application Publication No. 2000-73152 may be mentioned as an example of a method of refining the grain sizes of ferrite on the order of nanometers, which is smaller than 1 μm, in regard to the steel sheets that can be press formed. In this method, when laminating and rolling is repeated for 7 cycles, the structure becomes an ultrafine structure in which grain sizes are on the order of nanometers and the tensile strength reaches 3.1 times (870 MPa) as high as that of the IF steel which is used as a raw material. However, the method has two drawbacks.

The first drawback is that the ductility of the material is extremely low in the conditions under which the structure is made from only ultrafine grains, of which grain sizes are not more than 1 μm (hereinafter called "nanograins"). The reason for this is mentioned in the paper written by the inventors of the above reference, for example, "Iron and Steel" (The Iron and Steel Institute of Japan, Vol. 88 (2002), No. 7, p. 365, FIG. 6*b*). That is, the overall elongation greatly decreases, and the average elongation simultaneously decreases to approximately 0, when the grain sizes of ferrite are less than 1.2 μm. Such a structure is not suitable for steel sheets to be press formed.

The second drawback is that the production efficiency is decreased and the production cost thereby increases to a large extent when laminating and rolling is repeated in an industrial process. Large strain is required for the steel sheet in order to have ultrafine grains, and for example, the ultrafine grains are not obtained until 97% of the strain which is in terms of rolling rate is applied by 5 cycles of the laminating and the rolling. The ultra-refinement cannot be practically performed in ordinary cold rolling because the thickness of the steel sheet needs to be rolled from 32 mm to 1 mm thick, for example.

DISCLOSURE OF THE INVENTION

An object of the present invention is to provide a high-strength steel sheet in which the strength is improved by refining the ferrite grains while decreasing the amount of alloying elements added, the balance of strength and elongation required in press forming is superior, and the difference of static and dynamic stresses is 170 MPa or more. Another object of the present invention is to provide a production method for such a high-strength steel sheet.

The inventors have researched regarding the above high-strength steel sheet in which the strength is improved by refining the ferrite grains while decreasing the amount of alloying elements added, the balance of strength and elongation required in press forming is superior, and the difference of static and dynamic stresses is 170 MPa or more. As a result, the inventors have come to understand that a structure of a steel sheet may be formed without a single structure of ferrite of which grain sizes are not more than 1.2 μm (hereinafter simply called "nanograins" in the present invention), but with a mixed structure of nanograins and ferrite of which grain sizes are more than 1.2 μm (hereinafter simply called "micrograins" in the present invention). Based on this concept, the inventors have found a high-strength steel sheet in which an effect of nanograins is obtained at dynamic deformation and a low strength is obtained while decreasing the effect of nanograins in static deformation by balancing a ratio of the hard second phase and the structure other than the hard second phase in the steel sheet. Generally, the nanograin refers to a grain in which the grain size is not more than 1.0 μm and a micrograin refers to a grain in which the grain size is more than 1.0 μm in the technical field of the present invention. In contrast, the critical value of grain size that divides nanograins from micrograins is defined as 1.2 μm in the present invention, which is mentioned above.

That is, the high-strength steel sheet of the present invention has a metal structure consisting of a ferrite phase in which a hard second phase is dispersed and having 3 to 30% of an area ratio of the hard second phase. In the ferrite phase, the area ratio of nanograins is 15 to 90%, and dS as an average grain size of nanograins, and dL as an average grain size of micrograins, satisfy the following equation (1).

$$dL/dS \geqq 3 \quad (1)$$

In such a high-strength steel sheet, A (ave) as an average of Ai (i=1, 2, 3, . . . ) which is an area ratio of the hard second phase at each lattice, and standard deviation s, preferably satisfy the following equation (2), when 9 pieces or more of 3 μm square of lattice are optionally chosen in a cross section which is parallel to a rolling direction of the steel sheet.

$$s/A(\text{ave}) \leqq 0.6 \quad (2)$$

In such a high-strength steel sheet, C and at least one selected from a group consisting of Si, Mn, Cr, Mo, Ni and B are included, and C (amount of solid-solved carbon calculated by subtracting the amount of carbon combined with Nb and Ti from the total amount of carbon) preferably satisfies the following equations (4), (5), and (6) on the basis of the following equation (3). Component ratios (mass %) of the additive elements are substituted for each of the additive elements in equation (3).

$$F_1(Q)=0.65\text{Si}+3.1\text{Mn}+2\text{Cr}+2.3\text{Mo}+0.3\text{Ni}+2000\text{B} \quad (3)$$

$$F_1(Q) \geqq -40\text{C}+6 \quad (4)$$

$$F_1(Q) \geqq 25\text{C}-2.5 \quad (5)$$

$$0.02 \leqq \text{C} \leqq 0.3 \quad (6)$$

In such a high-strength steel sheet, compositions preferably satisfy the following equation (9) on the basis of the following equations (7) and (8). Component ratios (mass %)

of the additive elements are substituted for each of the additive elements in equations (7) and (8).

$$F_2(S) = 112\text{Si} + 98\text{Mn} + 218\text{P} + 317\text{Al} + 9\text{Cr} + 56\text{Mo} + 8\text{Ni} + 1417\text{B} \quad (7)$$

$$F_3(P) = 500 \times \text{Nb} + 1000 \times \text{Ti} \quad (8)$$

$$F_2(S) + F_3(P) \leqq 360 \quad (9)$$

In such a high-strength steel sheet, at least one of not more than 0.72 mass % of Nb and not more than 0.36 mass % of Ti, and at least one of not more than 2 mass % of P and not more than 18 mass % of Al are preferably included. Not more than 5 mass % of Si, not more than 3.5 mass % of Mn, not more than 1.5 mass % of Cr, not more than 0.7 mass % of Mo, not more than 10 mass % of Ni, and not more than 0.003 mass % of B are very preferably included.

The inventors have researched regarding a preferable production method for the above high-strength steel sheet. As a result, in order to obtain ultrafine grains by ordinary cold rolling, the inventors have found that a high-strength steel sheet with a mixed structure of micrograins and nanograins can be obtained by cold rolling at necessary rolling reduction in accordance with a distance between the hard second phases while the crystalline structure before rolling is a complex structure of soft ferrite and a hard second phase, and by annealing at a temperature and at time which inhibits the growth of grains.

That is, a production method for the high-strength steel sheet of the present invention comprises cold rolling which is performed on a hot-rolled steel sheet consisting of a metal structure of a ferrite phase and a hard second phase in a condition in which reduction index D satisfies the following equation (10), and annealing which is performed thereto, in a condition satisfying the following equation (11).

$$D = d \times t / t_0 \leqq 1 \quad (10)$$

(d: average distance between the hard second phases (μm), t: sheet thickness after cold rolling, $t_0$: sheet thickness between after hot rolling and before cold rolling)

$$680 < -40 \times \log(ts) + Ts < 770 \quad (11)$$

(ts: maintaining time (sec), Ts: maintaining temperature (° C.), log(ts) is common logarithm of ts)

In such a high-strength steel sheet, an average distance between the hard second phases is preferably not more than 5 μm in a direction of a sheet thickness of the hot-rolled steel sheet.

According to the present invention, the ratio of the hard second phase in the steel sheet with a mixed structure of nanograins and micrograins, and a structure other than the hard second phase, are balanced. Therefore, a high-strength steel sheet in which an effect of nanograins is obtained at dynamic deformation, and a low strength is obtained while decreasing the effect of nanograins at static deformation, is obtained.

According to the present invention, a high-strength steel sheet with a mixed structure of micrograins and nanograins is produced by cold rolling at necessary rolling reduction in accordance with a distance between the hard second phases while the crystalline structure before rolling is a complex structure of soft ferrite and a hard second phase, and by annealing in a temperature range which inhibits the growth of grains. The high-strength steel sheet of the present invention obtained by such a process has a strength which is improved by refining the ferrite grains while decreasing the amount of alloying elements, superior balance of strength and elongation required in press forming, and the difference of static and dynamic stresses which is 170 MPa or more.

BRIEF DESCRIPTION OF DRAWINGS

FIG. 1 is a drawing showing a frame format of a method for measuring a distance between the hard second phases in the hot-rolled steel sheet.

FIG. 2 is a diagram showing a heat history of the hot rolling.

BEST MODE FOR CARRYING OUT THE INVENTION

Figure 3:
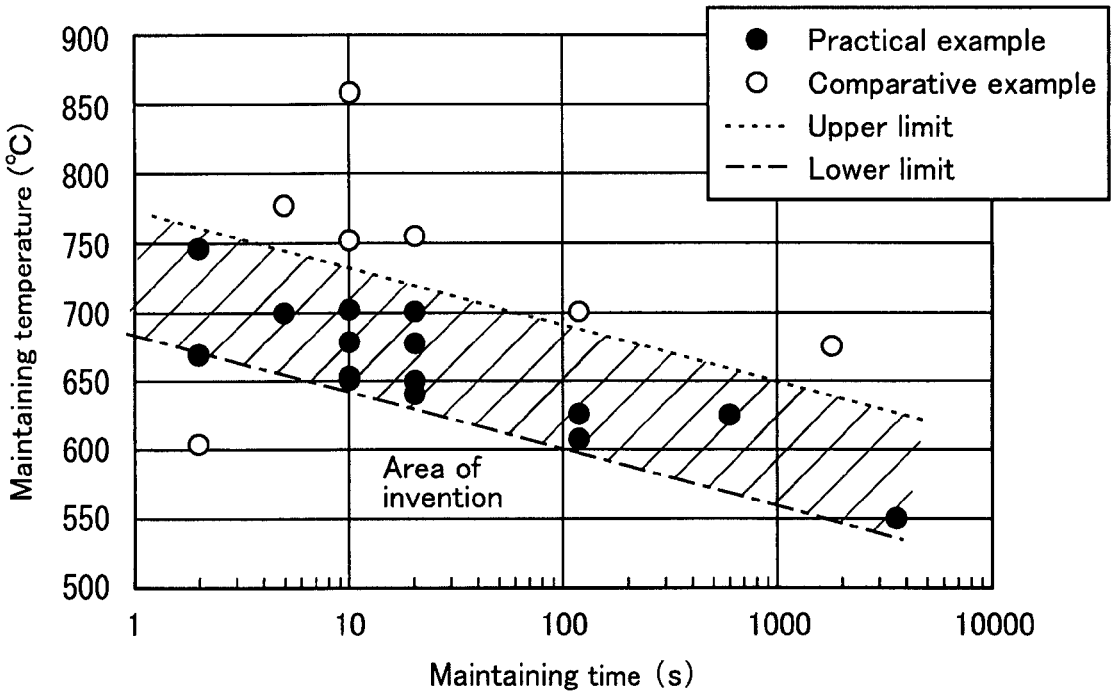
FIG. 3 is a graph showing a relationship between maintaining temperature and maintaining time of annealing.

A preferable embodiment of the present invention is explained hereinafter with reference to the drawings. First, the reasons for defining various setting equations in the high-strength steel sheet of the present invention are mentioned. It should be noted that all of the content of each element shown in the followings have a unit of mass %, but which are expressed only by "%" for convenience.

A carbon steel is used as a raw material of the high-strength steel sheet of the present invention, and it is required to have 0.02 to 0.3% of the solid-solved carbon calculated by subtracting the amount of carbon combined with Nb and Ti from the total amount of carbon, which is mentioned hereinafter. At least one selected from a first element group consisting of Si, Mn, Cr, Mo, Ni and B is included in the carbon steel for the purpose of improving the strength of steel by improving quenchability and solid solution strengthening. Moreover, at least one selected from a second group consisting of Nb and Ti is included as necessary for the purpose of improving the strength of the steel by refining of grains and precipitation strengthening. Furthermore, at least one selected from a third group consisting of P and Al is included as necessary for the purpose of improving the strength of the steel by solid solution strengthening.

The obtained steel should satisfy all of the following equations (4), (5), (6), and (9) on the basis of the following equations (3), (7), and (8), and chemical symbols in the following equations represent component ratios (mass %) of each element, for example, "Cr" represents a component ratio (mass %) of Cr.

$$F_1(Q) = 0.65\text{Si} + 3.1\text{Mn} + 2\text{Cr} + 2.3\text{Mo} + 0.3\text{Ni} + 2000\text{B} \quad (3)$$

$$F_1(Q) \geqq -40\text{C} + 6 \quad (4)$$

$$F_1(Q) \geqq 25\text{C} - 2.5 \quad (5)$$

$$0.02 \leqq \text{C} \leqq 0.3 \quad (6)$$

$$F_2(S) = 112\text{Si} + 98\text{Mn} + 218\text{P} + 317\text{Al} + 9\text{Cr} + 56\text{Mo} + 8\text{Ni} + 1417\text{B} \quad (7)$$

$$F_3(P) = 500 \times \text{Nb} + 1000 \times \text{Ti} \quad (8)$$

$$F_2(S) + F_3(P) \leqq 360 \quad (9)$$

The meanings of marks in the equations and the reasons for defining each equation are explained as follows.

Reasons for Defining the Equations (3), (4), and (5)

$F_1(Q)$ represents an index of quenchability of steel that is defined as shown in the equation 3 and is calculated from the component ratio (mass %) of each additive element.

The metal structure before cold rolling is important to have a complex structure of soft ferrite and a hard second phase (at least one of martensite, bainite, and residual austenite) in the production method for the high-strength steel sheet of the present invention, which is mentioned hereinafter. These structures are obtained by rapidly cooling the steel from the two phase region of ferrite and austenite after hot rolling, by cooling the steel to room temperature and directly heating after hot rolling, or by rapidly cooling the steel which was cold rolled and then was maintained at the two phase region of ferrite and austenite by heating after hot rolling. However, there are two problems about obtaining these structures.

First, the hard second phase is difficult to obtain because of low quenchability when the amount of carbon is small. Accordingly, addition of elements of the above first element group, which improves the quenchability, is required in order to obtain the hard second phase easily. In contrast, a small amount of additive elements for improving the quenchability is required when there is a lot of carbon because the necessary quenchability is inversely proportional to the amount of carbon. The above equation (4) shows this relationship. According to the equation (4), the necessary amount of the elements for improving the quenchability is added to the steel. The amount of carbon (C) represents the amount of solid-solved carbon calculated by subtracting the amount of carbon combined with Nb and Ti from the total amount of carbon, which is explained in detail hereinafter.

Second, pearlite transformation is easily occurs during cooling from the two phase region of ferrite and austenite when the amount of carbon is large, and the necessary hard second phase is difficult to obtain. The addition of the first element group is effective for avoiding this phenomenon. That is, a nose of a start of pearlite transformation in the continuous cooling transformation diagram (hereinafter simply called "CCT diagram") shifts toward the side of longer time by adding the element for improving the durability. Therefore, a complex structure of ferrite and hard second phase is formed without producing the pearlite. A large amount of elements for improving the quenchability is required because the pearlite transformation occurs easily when the carbon is included in a large amount. The above equation (5) shows this relationship. According to the equation (5), the necessary amount of the elements for improving the quenchability is added to the steel. It should be noted that the amount of carbon is represented by C which is mentioned above.

Explanation of C and Reason for Defining the Equation (6)

C represents the amount of solid-solved carbon calculated by subtracting the amount of carbon combined with the second element group (Nb and Ti) from the total amount of carbon and a value calculated by the following equation (12). It should be noted that component ratios (mass %) of the additive elements are substituted for each of the additive elements in equation (12).

$$C = (\text{total amount of carbon}) - (12/92.9 \times \text{Nb} + 12/47.9 \times \text{Ti}) \quad (12)$$

Each coefficient of 92.9 and 47.9 in equation (12) represents an atomic weight of Nb or Ti, and (12/92.9×Nb+12/47.9×Ti) represents the amount of carbon (mass %) which is combined with Nb or Ti and forms carbide. Therefore, the amount of solid-solved carbon is calculated by subtracting the amount of carbon that is combined with Nb or Ti and forms carbide, from the total amount of carbon.

The equation (6) defines an upper limit and a lower limit of the amount of the solid-solved carbon in order to produce the metal structure in the range of the optional amount before cold rolling. The lower limit is defined as 0.02% because the hard second phase is not produced even if the element for improving the quenchability is added to the steel and a single phase of ferrite is produced, when the amount of carbon is less than 0.02%. The grain size of steel having a single phase of ferrite cannot be refined to the order of nanometers, which is smaller than 1 μm, unless particular methods such as the above method of repeated laminating and rolling is applied.

The upper limit is defined as 0.3% because the intended complex structure of ferrite and the hard second phase is not obtained if the upper limit is more than 0.3%. The nose of pearlite transformation in the CCT diagram stays on the side of the shorter time even if the element for improving the quenchability is added when C is more than 0.3%. Accordingly, the nose of pearlite deformation is experienced at any cooling rate among the rapid cooling from the two-phase region of ferrite and austenite, whereby the metal structure before cold rolling becomes a complex structure of ferrite and pearlite.

It should be noted that the pearlite has a lamellar structure comprising ferrite and cementite, which is a compound of carbon and iron, and the cementite is so brittle against deformation that the energy of cold rolling is spent on breaking the cementite. Therefore, the soft ferrite phase, which is a property of a production method for the present invention, cannot have a large strain when pearlite is included in the structure of steel. Accordingly, C, which is an upper limit, is defined as 0.03% in order to avoid pearlite transformation by adding the element for improving the quenchability.

Reasons for Defining the Equations (7), (8), and (9)

$F_2(S)$ represents a strengthened amount of the high-strength steel sheet which is strengthened by an effect of solid solution strengthening of the first and the third element group, and is expressed by MPa calculated from mass % of the additive elements according to the equation (7). The coefficient multiplied by each element in equation (7) is calculated by the following equation (13) on the basis of the following concept.

$$(\text{Coefficient of each element}) = |r(X) - r(\text{Fe})| / r(\text{Fe}) \times M(\text{Fe}) / M(X) \times 1000 \quad (13)$$

It should be noted that r (X) represents an atomic radius of each element, r (Fe) represents an atomic radius of iron, M (X) represents an atomic weight of each element, and M (Fe) represents an atomic weight of iron.

The meaning of the equation (13) is explained as follows. That is, the difference of an atomic radius between a certain element and iron is divided by the atomic radius of iron, and the quotient thereof is proportional to the amount of solid solution strengthening with respect to the one element. In order to convert the unit into a unit with respect to mass % of the relevant element, the quotient is multiplied by the ratio of the atomic weight of iron and the relevant element, and moreover, the quotient is multiplied by 1000 to convert the unit into MPa. Physical constants of each element which was used and coefficients of equation (13) induced thereby are shown in Table 1.

TABLE 1

| | Chemical symbol | | | | | | | | |
|---|---|---|---|---|---|---|---|---|---|
| | Fe | Si | Mn | P | Al | Cr | Mo | Ni | B |
| Atomic radius r (X) | 1.24 | 1.17 | 1.12 | 1.09 | 1.43 | 1.25 | 1.38 | 1.25 | 0.9 |
| (r (X) − r (Fe))/r (Fe) | — | 0.0565 | 0.0968 | 0.1210 | 0.1532 | 0.0081 | 0.0968 | 0.0081 | 0.2742 |
| Atomic weight M (X) | 55.8 | 28.1 | 54.9 | 31.0 | 27.0 | 52.0 | 95.9 | 58.7 | 10.8 |
| M (Fe)/M (X) | — | 1.99 | 1.02 | 1.80 | 2.07 | 1.07 | 0.58 | 0.95 | 5.17 |
| Coefficient of equation (13) | — | 112 | 98 | 218 | 317 | 9 | 58 | 8 | 1417 |

$F_3(P)$ represents an index of the amount of the strengthening when the steel is strengthened by precipitation strengthening with carbides made from the above second element group and carbons in the steel, which is defined as shown in the above equation (8).

The meaning of the equation (8) is explained as follows. That is, Nb and Ti easily form carbides in a steel. For example, both the solubility product of Nb and carbon in the steel and the solubility product (mass %) of Ti and carbon are on the order of 10 to the −5th power at 800° C. Ti and Nb are scarcely able to exist as solid solutions in a carbon steel, but are able to exist as carbides combined with carbon one-to-one, that is, NbC or TiC. Therefore, the amount of precipitation strengthening which is proportional to the amount of the addition of Nb and Ti is expected. This case is applied when carbons which are not combined with Nb or Ti still remain, and the expected amount of precipitation cannot be obtained if a greater amount of Nb or Ti is added when all carbon is combined with Nb or Ti. Moreover, the amount of precipitation strengthening varies due to size of the precipitates.

Generally, the function of the precipitation strengthening decreases when the precipitates are coarse. The present invention does not expect to maintain the high-strength steel sheet at a temperature of 700° C. or more in which the carbides of Nb or Ti easily grow for a long time in annealing after cold rolling as mentioned below. Therefore, carbides of Nb or Ti are dispersed uniformly and finely in the steel, and the amount of precipitation strengthening is determined only by the amount of addition of Nb and Ti. The above equation (8) indicates this function.

Each coefficient of 500 and 1000 in the equation (8) represents the amount of precipitation strengthening with respect to 1 mass % of Nb or Ti, and was obtained from experiments. The total of the amount of the precipitation strengthening of Nb and Ti is represented as $F_3(P)$, that is, the total amount of precipitation strengthening.

With such technical expertise, the equation (9) indicates that the total amount of strengthening of iron performed by solid solution strengthening and precipitation strengthening should not be more than 360 MPa. Because of the large difference in static and dynamic stresses (the difference between static strength and dynamic strength), which is a property of the present invention, is not performed when the amount of the strengthening of steel sheet is too large. The purity of ferrite is lowered and deformation stress of ferrite does not tend to depend on strain rate when the ferrite is greatly strengthened by adding a large amount of alloying elements as mentioned above. The difference of static and dynamic stresses which is higher than that of the conventional steel is obtained in the metal structure of the high-strength steel sheet of the present invention when the purity of the ferrite is not less than a certain degree, but large difference in static and dynamic stresses are not produced when the purity of the ferrite is too low.

The inventors have researched regarding the quantification of the purity of the ferrite necessary for producing large difference in static and dynamic stresses. As a result, the inventors experimentally demonstrated the degree of the negative effect of each additive element on the difference of static and dynamic stresses of ferrite to be proportional to the amount of strengthening of ferrite (solid solution strengthening and precipitation strengthening) with respect to unit amount of addition (mass %). The inventors have researched based on these results, and they have demonstrated the upper limit of the amount of the strengthening of ferrite necessary for producing large difference in static and dynamic stresses to be 360 MPa. The above equation (9) defines this result.

Reasons for Defining Each Chemical Composition

The reasons for defining each chemical composition in the high-strength steel sheet of the present invention are mentioned hereinafter. It should be noted that all of the content of each element shown in the followings have units of mass %, but which are expressed only as % for convenience. Carbon is individually defined by the equation (6), the other elements are individually defined by the equations (4) and (5) for the lower limit and the equations (9), (14), and (15) for the upper limit in most cases, and moreover, the upper limits are individually determined.

$$Cr \leqq 1.5 \tag{14}$$

$$Mo \leqq 0.7 \tag{15}$$

C: 0.02 to 0.3% as solid-solved carbon

A mixed structure of ferrite and austenite is formed at high temperature by adding carbon, and the hard second phase of martensite, bainite, and residual austenite is formed by rapidly cooling thereof. Therefore, carbon is the most important element in the present invention.

The solid-solved carbon without carbon precipitated as a carbide satisfies the equation (6) by adjusting the amount of carbon when Nb and Ti are added to the high-strength steel sheet of the present invention. The amount of addition of carbon is adjusted in order that the solid-solved carbon other than the carbon precipitated as a carbide when Nb and Ti are added to the high-strength steel sheet of the present invention satisfies the above equation (6). The metal structure before cold rolling is transformed into ferrite when the amount of the solid-solved carbon is less than 0.02% and is transformed into a complex structure of ferrite and pearlite when the amount of the solid-solved carbon is more than 0.3%, both of which are not suitable for the production method for the high-strength steel sheet of the present invention.

The First Element Group: Si, Mn, Cr, Mo, Ni, and B

The elements of the first element group are added to the steel for improving the quenchability and improving the strength by solid strengthening. The amount of addition is adjusted to satisfy the equations (4), (5), (9), (14), and (15). The reasons for defining the upper limit and lower limit of the amount of addition of each element are explained hereinafter.

Si: 0.2 to 5%

The improvement of quenchability is not clearly produced when the amount of addition of Si is less than 0.2%. Therefore, the lower limit is defined as 0.2%. $Fe_3Si$, which is an intermetallic compound having crystalline structure type of D03 or B2, is formed by combining Si with Fe and decreases the ductility of steel when the amount of addition of Si is more than 5%. Therefore, the upper limit is defined as 5%.

Mn: 0.1 to 3.5%

The improvement of quenchability is not clearly produced when the amount of addition of Mn is less than 0.1%. Therefore, the lower limit is defined as 0.1%. The austenite exists as a stabilized phase in addition to ferrite at room temperature when the amount of addition of Mn is more than 3.5%. Austenite is undesirable because austenite has low strength and lowers the strength of overall steel. Therefore, the upper limit is defined as 3.5%.

Cr: 0.1 to 1.5%

The improvement of quenchability is not clearly produced when the amount of addition of Cr is less than 0.1%. Therefore, the lower limit is defined as 0.1%. The amount of solid-solved chromium is not obtained as much as the amount of addition, and quenchability may not be improved because the carbon in the steel and Cr combine to make carbide when the amount of addition of Cr is more than 1.5%. Therefore, the upper limit is defined as 1.5% at which Cr is able to exist in a solid-solved state.

Mo: 0.1 to 0.7%

The improvement of quenchability is not clearly produced when the amount of addition of Mo is less than 0.1%. Therefore, the lower limit is defined as 0.1%. The amount of solid-solved molybdenum is not obtained as much as the amount of addition, and quenchability may not be improved because the carbon in the steel and Mo combine to make carbide when the amount of addition of Mo is more than 0.7%. Therefore, the upper limit is defined as 0.7% at which Mo is able to exist in a solid-solved state.

Ni: 0.2 to 10%

The improvement of quenchability is not clearly produced when the amount of addition of Ni is less than 0.2%. Therefore, the lower limit is defined as 0.2%. The austenite exists as a stabilized phase besides ferrite at room temperature when the amount of addition of Ni is more than 10%. Austenite is undesirable because austenite has low strength and lowers the strength of overall steel. Therefore, the upper limit is defined as 10%.

B: 0.0005 to 0.003%

The improvement of quenchability is not clearly produced when the amount of addition of B is less than 0.0005%. Therefore, the lower limit is defined as 0.0005%. The solid solubility limit of B of the ferrite is extremely small, and B mainly segregates in the grain boundary of the steel when the amount of addition of B is small, but the areas of grain boundaries are not enough for B to exist when the amount of addition of B is more than 0.003%, whereby $Fe_2B$, which is an intermetallic compound, is produced and lowers the ductility of the steel. Therefore, the upper limit is defined as 0.003%.

The Second Element Group: Nb and Ti

The elements of the second element group are added as necessary for refining the grains and strengthening the steel by precipitation strengthening. The reasons for defining the upper limit and lower limit of the amount of addition of each element are explained hereinafter.

Nb: 0.01 to 0.72%

The effect of refining and precipitation strengthening is not clearly obtained when the amount of addition of Nb is less than 0.01%. Therefore, the lower limit is defined as 0.01%. The equation (8) clearly shows that the amount of precipitation strengthening comes to 360 MPa only by NbC when the amount of addition of Nb is more than 0.72%, which does not satisfy the above equation (9), whereby the upper limit of Nb is defined as 0.72%.

Ti: 0.01 to 0.36%

The effect of refining and precipitation strengthening is not clearly obtained when the amount of addition of Ti is less than 0.01%. Therefore, the lower limit is defined as 0.01%. The equation (8) clearly shows that the amount of precipitation strengthening comes to 360 MPa only by TiC when the amount of addition of Ti is more than 0.36%, and which does not satisfy the above equation (9), whereby the upper limit of Ti is defined as 0.36%.

The Third Element Group: P and Al

The elements of the third element group are added as necessary as elements for strengthening the steel. The reasons for defining the upper limit and lower limit of the amount of addition of each element are explained hereinafter.

P: 0.03 to 2%

Addition of P is effective as an element for solid solution strengthening of the steel that is not clearly obtained when the amount of addition is less than 0.03%. Therefore, the lower limit is defined as 0.03%. $Fe_3P$, which is an intermetallic compound is produced and lowers the ductility of the steel when the amount of addition of P is more than 2%. Therefore, the upper limit is defined as 2%.

Al: 0.01 to 18%

Al is an element for solid solution strengthening and is effective as a deoxidizing agent, thereby making "killed steel" from a steel. Al combines with dissolved oxygen in the steel in the process of steelmaking, and emerges as an alumina, which is removed in order to improve the ductility and the toughness of the steel. Accordingly, Al is added as necessary. It should be noted that the function as a deoxidizing agent and as an element for solid solution strengthening are not obtained when the amount of addition is less than 0.01%. Therefore, the lower limit is defined as 0.01%. On the other hand, $Fe_3Al$, which is an intermetallic compound, is produced and lowers the ductility of steel when the amount of addition of Al is more than 18%. Therefore, the upper limit is defined as 18%.

Reasons for Defining the Structure

The metal structure of the high-strength steel sheet of the present invention is explained in detail.

The metal structure of the high-strength steel sheet of the present invention should satisfy all the requirements mentioned in the following paragraphs 1, 2, 3, and 4.

The metal structure of the high-strength steel sheet of the present invention should satisfy all the requirements mentioned in the following paragraphs 1, 2, 3, and 4.

1. The metal structure comprises a ferrite phase and a hard second phase (at least one selected from a group consisting of cementite, pearlite, martensite, bainite, and residual austenite). The area ratio of the hard second phase is 3 to 30%, which is measured on the secondary electron image (hereinafter called "SEM image") photographed at a magnification ratio of 5000 by a scanning electron microscope, after a cross section parallel to the rolling direction of a steel sheet is cut out and is etched with nitric ethanol.

2. The hard second phase is uniformly dispersed in the ferrite phase of the metal structure, and satisfies the following requirement. That is, A(ave) as an average of Ai (i=1, 2, 3 and so on) which is an area ratio of hard second phases at each lattice, and standard deviation s, preferably satisfy the following equation (2) when not less than 9 pieces of 3 μm square of lattice are optionally chosen in a SEM image of a cross section which is parallel to a rolling direction of the steel sheet and is photographed at a magnification ratio of 5000.

$$s/A(\text{ave}) \leqq 0.6 \quad (2)$$

3. In a SEM image photographed at a magnification ratio of 5000 of a cross section parallel to a rolling direction of the steel sheet, the area ratio of nanograins in ferrite portion in which the hard second phase is excluded from the total area is 15 to 90%.

4. An average grain size of nanograins dS and an average grain size of micrograins dL satisfy the following equation (1).

$$dL/dS \geqq 3 \quad (1)$$

It should be noted that the average grain size corresponds to a radius of a circle determined by each area of ferrite grains, all of which are measured by image analysis in a SEM image photographed at a magnification ratio of 5000 of a cross section parallel to a rolling direction of the steel sheet. Specifically, when the area of ferrite grains measured by image analysis is defined as Si (i=1, 2, 3, and so on), Di (i=1, 2, 3, and so on) corresponding to a radius of a circle is calculated by the following equation (16).

$$Di=2(Si/3.14)^{1/2} \quad (16)$$

The reasons for defining the above requirements 1 to 4 are explained hereinafter. That is, solid solution elements such as carbon are extracted from the ferrite portion to the hard second phase by dispersing and precipitating an appropriate amount of the hard second phase uniformly, whereby the ductility of steel is increased and the difference of static and dynamic stresses is increased. The purity of the ferrite portion which has low density of the hard second phase is lowered when the hard second phases are nonuniformly dispersed, whereby the high ductility and the high difference of static and dynamic stresses cannot be performed.

The reason for defining the area ratio of the hard second phase as 3 to 30% is described below. That is, the difference of static and dynamic stresses is not increased because the purity of ferrite is not high enough when the area ratio of the hard second phase is less than 3%. On the other hand, the difference of static and dynamic stresses in the overall material is not improved because the negative effect of the hard second phase which is low purity and has low difference of static and dynamic stresses is strengthened although the purity of ferrite and the difference of static and dynamic stresses are high when the area ratio of the hard second phase is more than 30%.

It should be noted that the hard second phase in the structure of the high-strength steel sheet of the present invention comprises a phase equilibrated with ferrite, a structure transformed from the equilibrium phase during the process of cooling, and a structure transformed by annealing the transformed structure. Specifically, the hard second phase consists of at least one or more selected from a group consisting of cementite, pearlite, martensite, bainite, and residual austenite. Cementite exists as a phase equilibrated with ferrite in a steel, and pearlite, martensite, bainite, and residual austenite are structures transformed from the equilibrium phases. The residual austenite is untransformed austenite that exists as an equilibrium phase only at high temperature and remains at room temperature, and the structure thereof is included as a transformed structure since the structure is obtained at room temperature by cooling austenite, although the residual austenite is practically not transformed.

In addition to these phases and structures, tempered bainite, tempered martensite, troostite, sorbite and a structure which has spheroidized cementite formed by annealing pearlite exist. These structures are included as any of the hard second phase of which names are specifically mentioned above.

The tempered bainite which is a toughened structure formed by annealing bainite at 300 to 400° C. has a mixed structure of ferrite and cementite with high dislocation density, and is not substantially different from bainite, thereby included as bainite in the present invention.

The tempered martensite, which is toughened by annealing martensite and lowering the hardness thereof, is included as martensite in the present invention. Tempering of martensite is a process of decomposing martensite with a supersaturated solid-solved carbon into ferrite and carbide. For example, as shown in Steel Materials, Modern Metallurgy Course, Material Volume 4, p. 39, compiled by the Japan Institute of Metals, ferrite has high dislocation density, and a composition of packets and blocks which is a property of lath martensite is not changed, even though ferrite is tempered at 300 to 500° C. Therefore, even a tempered martensite has a high degree of hardness and does not lose properties of martensite. Moreover, as shown on p. 39 in the above reference, solid-solved carbons which are supersaturated in martensite right after hardening are extremely easy to diffuse, whereby carbons migrate and start a preparatory step of precipitation from about −100° C. Accordingly, as-hardened martensite and a tempered martensite are difficult to distinguish clearly. Martensite and tempered martensite are included as the same structure in the present invention in view of the above case.

Troostite, which is not often used now, is categorized as tempered troostite and hardened troostite in "JIS G 0201 Glossary of terms used in iron and steel (Heat treatment)". Tempered troostite which is a structure produced when martensite is tempered consists of fine ferrite and cementite, but is practically tempered martensite. Hardened troostite is a structure of fine pearlite produced by hardening, and it is included as pearlite in the present invention.

Sorbite, which is not often used now, is categorized as tempered sorbite and hardened sorbite in "JIS G 0201 Glossary of terms used in iron and steel (Heat treatment)". Tempered sorbite is a mixed structure of cementite and ferrite, which are precipitated and grown spherically by tempering of martensite, but it is practically tempered martensite. Hardened sorbite is a structure of fine pearlite produced by hardening, and it is included as pearlite in the present invention.

A structure which has spheroidized cementite formed by annealing of pearlite is a mixed structure of ferrite and cementite, and in other words, the second hard phase is cementite.

A ferrite portion except for the hard second phase is explained hereinafter. The structure of a ferrite portion is a mixed structure that has various grain sizes of nanograins and micrograins. Therefore, the structure of ferrite has a relatively low strength and a superior balance of the strength and the ductility at press forming, and shows superior strength at high speed deformation such as crashes after it is manufactured into a product. Accordingly, the formability and the absorption characteristics of impact energy are balanced at a high degree by the structure of ferrite.

The reason for defining the grain size of a nanograin to be not more than 1.2 μm is described below. That is, for example, "Iron and Steel" (The Iron and Steel Institute of Japan, Vol. 88 (2002), No. 7, p. 365, FIG. 6*b*) discloses that the material property, specifically, the ductility discontinuously varies when a grain size of ferrite reaches a region of about 1.2 μm. Specifically, the overall elongation greatly decreases and the average elongation is not performed when the grain sizes of ferrite is less than 1.2 μm.

The reasons for defining various kinds of equations, chemical compositions, and structures relating to the high-strength steel sheet of the present invention are mentioned above. The functions regarding effects of the high-strength steel sheet of the present invention are explained in detail hereinafter.

First Function Regarding Effects of the High-Strength Steel Sheet of the Present Invention The following are functions of obtaining the large difference in static and dynamic stresses by making ferrite into a mixed structure of nanograins and micrograins. The high-strength steel sheet of the present invention is a steel sheet with a complex structure which comprises an extremely high strength portion of nanograins of which grain sizes are not more than 1.2 μm and an ordinary strength portion of micrograins of which grain sizes are more than 1.2 μm. The behavior of static deformation of the high-strength steel sheet of the present invention is the same as the deformation behavior of ordinary steel sheet with a complex structure, and the deformation first starts from the most deformable portion of a material, specifically, an inside of the micrograins or an interface of nanograins in micrograins at static deformation. Afterward, the deformation mainly proceeds slowly by micrograins. Therefore, the deformation proceeds by a stress that is equal to the stress when the deformation proceeds only by micrograins, and the strength and the ductility are balanced in general.

The deformation behavior of high-strength steel sheet of the present invention differs from ordinary steel sheets when the fast deformation is about 1000/s of the strain rate. The deformation rate is about 100,000 times as fast as that of the static deformation, and the deformation that proceeds mainly by soft micrograins is thereby difficult to follow. Therefore, deformations of the insides of nanograins are required besides the deformation of micrograins. Accordingly, the effect of the nanograins that have extremely high strength greatly increases, and a high deformation stress is required.

This phenomenon occurs when the ratio of nanograins is in the range of 15 to 90%. The effect of the nanograins is small when the ratio of nanograins is less than 15%, and the soft micrograins are deformed by a sufficient amount in both cases of a static deformation and a dynamic deformation, whereby the difference of static and dynamic stresses does not increase. On the other hand, the effect of the nanograins is large at the static deformation because the structure is almost entirely made of nanograins when the ratio of nanograins is more than 90%, and which is not suitable for press forming due to the low ductility, although the strength is high. Accordingly, superior strength of fast deformation, high absorption characteristics of impact energy, and superior workability cannot be balanced when the ratio of nanograins is less than 15% and more than 90%.

The above explanations regard the high-strength steel sheet of the present invention, and the preferable method of production for the high-strength steel sheet is explained hereinafter. The high-strength steel sheet of the present invention may be produced by ordinary production processes for cold-rolled steel sheets, that is, the processes of slab ingot, hot rolling, cold rolling, and annealing.

Slab Ingot

Slab ingot is performed by an ordinary method with certain compositions. Industrially, ingot irons are directly used, or cold iron sources such as commercial scraps and intermediate scraps yielded in a production process for steel are melted in an electric furnace or a steel converter and then refined in oxygen, and they are cast by continuous casting or batch casting. In small facilitates such as a pilot plant or a laboratory, raw materials of steel such as electrolytic iron and scraps are melted in a furnace in a vacuum or in air, and are cast into a mold after adding certain alloying elements, thereby obtaining materials.

Hot Rolling

Hot rolling is a first important process in the production method for the high-strength steel sheet of the present invention. The crystalline structures after hot rolling are made to have a complex structure of a main phase of ferrite and a hard second phase of which the area ratio is in a range of 10 to 85%, and the average distance between the hard second phases measured in the direction of sheet thickness is not more than 5 μm in the production method of the present invention.

The hard second phase mentioned here is a hard second phase of a final structure of the high-strength steel sheet of the present invention without pearlite and cementite, and has at least one of martensite, bainite, and residual austenite. The metal structure of the high-strength steel sheet of the present invention cannot be obtained when the hard second phase consists of cementite or pearlite.

The reason for selecting the above hard second phase is explained as follows.

The metal structure of the high-strength steel sheet of the present invention has nanograins of which area ratio is 15 to 90% in the ferrite phase. The following treatments are performed in order to obtain the metal structure. That is, first, the metal structure has a complex structure of ferrite and the hard second phase before cold rolling. Second, to the soft ferrite is applied a large shear strain by cold rolling. Finally, the soft ferrite is annealed to have nanograins of which grain sizes are not more than 1.2 μm.

The hard second phase (at least one of martensite, bainite, and residual austenite), which existed before cold rolling, is transformed by cold rolling, but the shear strain in the transformation is not so large as that in the ferrite portion. Therefore, nanograins are not produced in the annealing process after cold rolling. The hard second phase transforms into ferrite precipitating cementite or goes through an ordinary process of static recrystallization in which cores of new ferrite grains with a little strain are yielded and grown. Thus, micrograms in which grain sizes are on the order of micrometers are formed. A mixed structure of nanograins and micrograins are obtained by such a function.

The hard second phase should have higher hardness than that of a ferrite matrix and be transformed into ferrite after cold rolling and annealing. That is, the hard second phase required for the production method of the present invention is not a simple structure of carbide such as cementite, but is a structure with a high degree of hardness, which is mainly composed of ferrite or austenite.

The reason that martensite, bainite, and residual austenite are suitable for the hard second phase of the present invention is described below.

Martensite is ferrite comprising supersaturated carbon, and the degree of hardness is high because the dislocation density is high due to the strain in the crystal lattice applied by carbon. The content of carbon of the martensite is up to about 0.8%, which is the carbon concentration of eutectic of Fe and $Fe_3C$ in a phase equilibrium diagram of Fe—C, and which is less than that of cementite represented by the chemical formula $Fe_3C$. Therefore, the martensite is transformed into ferrite precipitating cementite in an annealing process after cold rolling. Accordingly, martensite satisfies the requirement for the hard second phase of the present invention that the structure be mainly composed of ferrite and have a high degree of hardness.

Bainite is a structure transformed at a slightly higher temperature than the temperature at which martensitic transformation is started, and it has a mixed structure of feather or acicular ferrite and fine cementite. Bainite includes a large amount of dislocation in the ferrite portion, which is not as great as that in martensite (compiled by the Japan Institute of Metals, Steel Materials, Modern Metallurgy Course, Material Volume 4, P. 35), and the ferrite portion with high dislocation density has a high degree of hardness as well as has cementite. Accordingly, bainite satisfies the requirement for the hard second phase of the present invention that the structure is mainly composed of ferrite and has a high degree of hardness.

Bainite is a mixed structure of ferrite and cementite, which is clearly explained in the above, and the whole structure of cementite and a ferrite portion with high dislocation density may be regarded as a hard second phase, thereby clearly being differentiated from cementite which exists alone as a hard second phase in the ferrite matrix with low dislocation density.

Bainite and cementite are clearly distinguished by observation of metal structure. When a cross section of a steel is observed through a light microscope after polishing and etching, in the bainite structure, portions of acicular ferrite are observed to be dark because of high dislocation density, and the ferrite matrix with low dislocation density around the acicular ferrite is observed to be light. On the other hand, the structure with only cementite is observed as a spherical precipitation phase of gray in the light ferrite matrix.

The residual austenite is transformed into martensite by strain-induced transformation due to the strain in the process of rolling, and it has the same effect as that of the martensite. Moreover, the transformation of the structure of the residual austenite at an annealing process after cold rolling is the same as that of the martensite. Accordingly, the residual austenite satisfies the requirement for the hard second phase of the present invention.

A case in which the hard second phase comprises only cementite or pearlite is explained. The pearlite is a mixed structure comprising ferrite and cementite in the form of laminae, and the lamellar cementite functions as a hard second phase. Therefore, the case of the hard second phase comprising cementite and the case of the hard second phase comprising pearlite are substantially the same. The soft ferrite portion, which is a characteristic of the present invention, is difficult to have large shear strain by cold rolling, when the hard second phase is made from cementite. This is because the cementite is extremely brittle against deformation, and the energy of cold rolling is used for rupturing the cementite, whereby ferrite is not effectively applied with strain.

Nanograins are produced by cold rolling at high reduction such that the rolling rate is not less than 85%. However, a mixed structure of nanograins and micrograins which is a characteristic of the present invention, is not obtained in that case because the transformation at the process of annealing after cold rolling greatly differs from the case in which the second hard phase comprises martensite, bainite, or residual austenite. The cementite which is in a metastable phase is transformed into a spherical shape in the case in which the shape is lamellar, but it remains as cementite when the annealing temperature is not more than the transformation temperature Ac1 in the annealing process after cold rolling with high reduction. Therefore, the structure after annealing is ferrite of nanograins and cementite, and a mixed structure that has a characteristic of the steel of the present invention, is not obtained. Accordingly, increasing of hardness at the fast deformation, that is, the property of high difference of static and dynamic stresses, is not obtained.

The cementite portion which has an extremely high concentration of carbon is preferentially transformed into austenite, and it is transformed into a mixed structure which has at least one selected from a group consisting of pearlite, martensite, bainite, and residual austenite in the cooling process afterwards when the annealing temperature is not less than the transformation temperature Ac1. Therefore, a mixed structure of ferrite, which is nanograins, and of the above transformation structure, is obtained. The large difference in static and dynamic stresses, which is a characteristic of the steel of the present invention is not obtained. In the final metal structure of the steel of the present invention, cementite may be used for the phases except the ferrite phase, and the ferrite phase is important to have a mixed structure of nanograins and micrograins.

The method for measuring the hard second phase in the hot-rolled steel sheet is explained as follows. A cross section parallel to the rolling direction of the hot-rolled steel sheet is photographed at 400 to 1000× magnification by a light microscope. Then, three straight lines are drawn at optional positions in the direction of sheet thickness as shown in FIG. 1 (only one straight line is drawn as an example). A distance from an interface of a first hard second phase and a ferrite to a next interface through a ferrite grain on the straight line is measured by a scale and is converted into the unit of μm. This operation is carried out on the all hard second phases cut in the image, and all measured values are averaged to determine an average distance of the hard second phase.

A production method to obtain objective structures is explained. FIG. 2 is a diagram showing a heat history of the hot rolling. As shown in FIG. 2, a slab is heated to the austenite region, that is, not less than the transformation point Ac3, and is final rolled after rough rolling. The final rolling is performed at just above the transformation point Ar3, that is, the range in which ferrite does not precipitate and the austenite region which is as low as possible, in order to inhibit the growth of grains at rolling. Afterward, the slab is cooled to the two phase region of ferrite and austenite, whereby a mixed structure of ferrite and austenite is obtained.

The nucleation density of ferrite, which nucleates from the grain boundary of austenite, is increased by inhibiting the growth of austenite grains at rolling, and the grain size thereby may be fined. The processed ferrite directly remains at room temperature if the ferrite is precipitated at rolling, whereby the effect of precipitating fine ferrite by transformation decreases.

Then, the steel is maintained at the two-phase region or is cooled rapidly without being maintaining. The austenite portion is transformed into the hard second phase in the process of rapid cooling, and refinement of grains in the process of maintaining a two-phase region is effective for narrowing the distance between the hard second phases.

The rapid cooling from the two-phase region is performed at a specific cooling rate or higher. The specific cooling rate is a critical cooling rate determined by compositions of a steel, in which a temperature of a steel sheet reaches an Ms point (a starting temperature of martensitic transformation) without crossing a nose of starting points of pearlite transformation in the CCT diagram.

When the cooling rate is high enough not to cross a nose of starting points of bainite transformation in the CCT diagram, the hard second phase is martensite. When cooling is performed to not more than the Ms point with crossing the nose of starting points of bainite transformation, the hard second phase is a mixed structure of martensite and bainite. Moreover, when cooling is performed to room temperature after having stopped cooling and having maintained at just above the Ms point, the hard second phase is bainite.

When cooling is performed to room temperature after having stopped cooling and having been maintained at just above the Ms point in a condition in which Si or Al is increased as compositions of high-strength steel sheets, the hard second phase comprises residual austenite besides bainite. It is important that the hard second phase other than the ferrite be inhibited from including cementite by avoiding pearlite transformation.

In a metal structure observed in a cross section parallel to the rolling direction of a steel sheet after hot rolling, an average distance between the hard second phases determined in the direction of the sheet thickness is preferably not more than 5 μm in the production method for high-strength steel sheets. The reason therefor is explained hereinafter.

Cold Rolling

When an average distance between the hard second phases of a structure after hot rolling is expressed as d (μm), a sheet thickness after hot rolling (before cold rolling) is expressed as to, and a sheet thickness after cold rolling is expressed as t, cold rolling is performed in a condition in which reduction index D satisfies the following equation (10).

$$D=d\times t/t_0\leqq 1 \quad (10)$$

The above d is defined as not more than 5 μm in the present invention. When d is more than 5 μm, large load must be applied to a rolling machine in order to roll a high-strength steel sheet of the present invention because $t/t_0$ is not more than 0.2, that is, high reduction rolling at more than 80% of reduction rate is required according to the equation (10). Even if rolling reduction with respect to one pass of rolling is decreased by using a tandem mill with 4 or 5 steps, the necessary rolling reduction is not obtained by one rolling, and rolling is required to be performed twice. Therefore, in the present invention, the distance between the hard second phases of the hot-rolled steel sheet is limited to not more than 5 μm, in order to obtain a structure of nanograins even though the rolling reduction is not more than 80%, which may be actually carried out by one rolling.

Annealing

Annealing is a process for eliminating working strain by heat treatment of a material after cold rolling and also forming a required metal structure. Annealing comprises a process of heating, maintaining, and cooling for a material after cold rolling, and the maintaining temperature Ts (° C.) and the maintaining time ts (sec) at Ts satisfy the following equation (11).

$$680<-40\times\log(ts)+Ts<770 \quad (11)$$

(ts: maintaining time (sec), Ts: maintaining temperature (° C.), log(ts) is a common logarithm of ts)

FIG. 3 is a graph showing an appropriate region of the above maintaining temperature and maintaining time. When a value of (−40×log(ts)+Ts) is not more than 680 (° C.), an area ratio of nanograins is undesirably more than the 90% which is the upper limit. On the other hand, when the above value is not less than 770 (° C.), the area ratio of nanograins is undesirably less than the 15% which is the lower limit.

Figure 4:
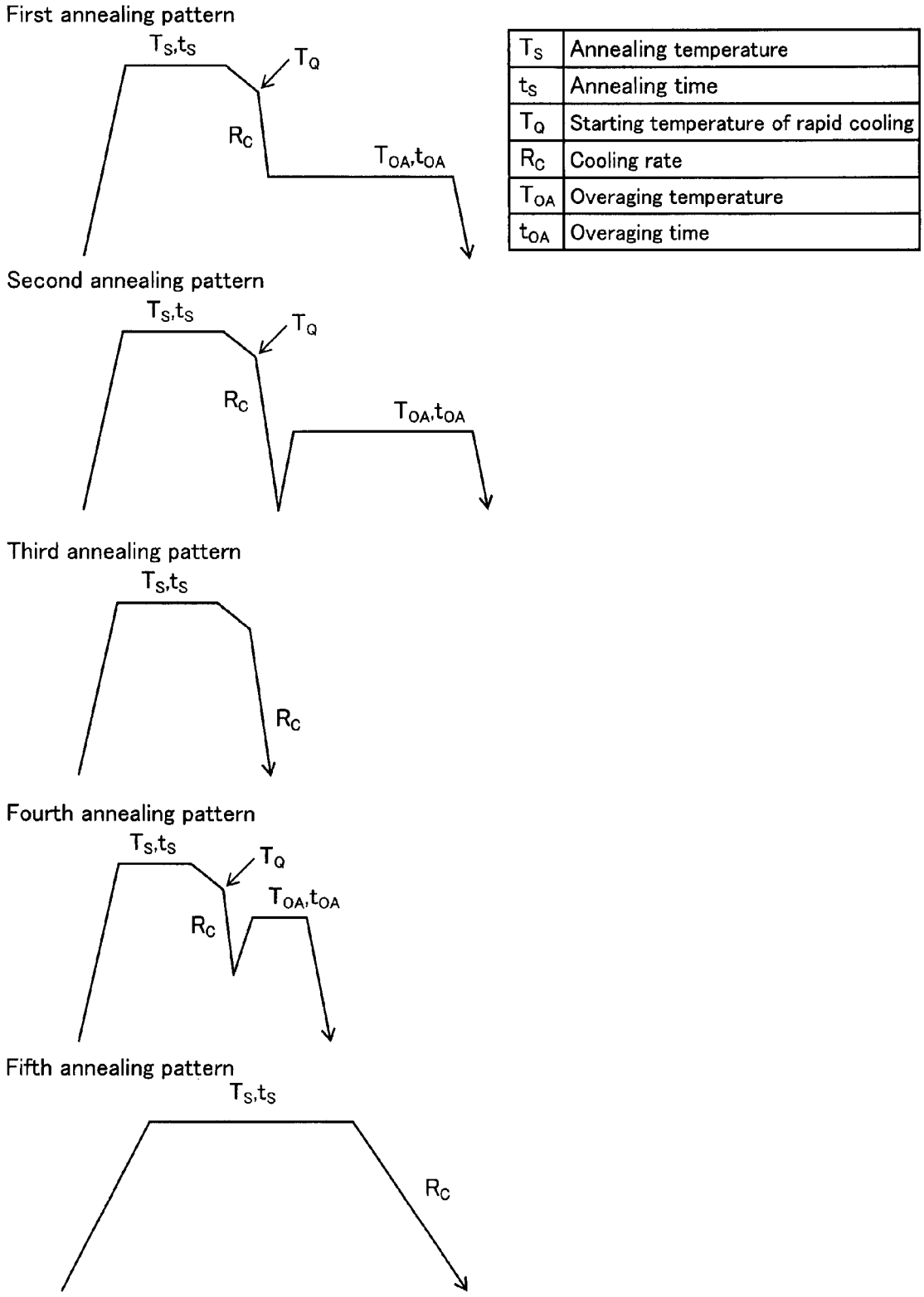
FIG. 4 shows diagrams of heat histories of five annealing patterns.

The hard second phase in a metal structure after annealing varies in accordance with the annealing pattern. FIG. 4 shows diagrams of various annealing patterns. FIG. 4 shows patterns 1, 2, and 3 which are a case of a CAL (continuous annealing line), pattern 4, which is a case of a CGL (hot dip galvanizing line), and pattern 5, which is a case of box annealing. The structures obtained by applying each annealing pattern shown in FIG. 4 are listed in Table 2.

TABLE 2

| Annealing pattern | Ts | $T_Q$ | Kind of second phase | Notes |
|---|---|---|---|---|
| 1 CAL with overaging | Not less than transformation point Ac1 | Not less than transformation point Ac1 | P, M, B, A | Continuous annealing line |
| | Not more than transformation point Ac1 | No set condition | C | |
| 2 CAL with reheating overaging | Not less than transformation point Ac1 | Not less than transformation point Ac1 | P, M, B, A | Continuous annealing line |
| | Not more than transformation point Ac1 | No set condition | C | |
| 3 CAL without overaging | Not less than transformation point Ac1 | Not less than transformation point Ac1 | P, M, B | Continuous annealing line |
| | Not more than transformation point Ac1 | No set condition | C | |

TABLE 2-continued

| Annealing pattern | Ts | $T_Q$ | Kind of second phase | Notes |
|---|---|---|---|---|
| 4 CGL | Not less than transformation point Ac1 | Not less than transformation point Ac1 | P, M, B, A | Hot dip galvanizing line |
| | Not more than transformation point Ac1 | No set condition | C | |
| 5 Box annealing | Not more than transformation point Ac1 | No set condition | C | |

P: pearlite,
M: martensite,
B: bainite,
A: residual austenite,
C: cementite

First, the annealing temperature is explained. A complex structure of ferrite and cementite may be obtained when the annealing temperature Ts is set to not more than the transformation point Ac1. When the annealing temperature Ts and the starting temperature of rapid cooling $T_Q$ are set to not less than the transformation point Ac1, a mixed structure may comprise ferrite as a matrix and at least one (the hard second phase) of a transformation structure from austenite and an annealed structure after annealing the transformation structure.

The transformation structures from austenite are pearlite, martensite, bainite, and residual austenite. The residual austenite is actually not transformed, but it is included in a transformation structure since the structure is obtained at room temperature by cooling austenite. The annealed structure after annealing the transformation structure is an annealed structure of the above transformation structure, and it is included in any of the above transformation structures as is explained in the above [0088] to [0092].

Even if the annealing temperature Ts and the starting temperature of rapid cooling $T_Q$ are not less than the transformation point Ac1, a carbon in a steel is not sufficientt in condensing into austenite, and supersaturated carbon may remain in ferrite when the rate of temperature rise is high and maintaining time is short, whereby the carbon may precipitates as cementite at cooling. Therefore, in this case, a mixed structure comprises at least one (hard second phase) selected from a group consisting of ferrite as a matrix, a transformation structure from austenite, and an annealed structure after annealing the transformation structure, and cementite is sometimes included in the ferrite.

The transformation point Ac1 is determined by compositions of a material and heating rate, and is between 700 to 850° C. in the present invention.

Next, a cooling method after annealing is explained. Cooling is performed by using gas, by spraying with water or a mixture of water and gas, by quenching (WQ) in a water tank, or by contact cooling with a roll. It should be noted that the gas is selected from a group consisting of air, nitrogen, hydrogen, mixed gas of nitrogen and hydrogen, helium, and argon.

When the cooling rate is too low during the above cooling process, ferrite grains greatly grow and an area ratio of nanograins decreases. Therefore, the cooling rate is set to not less than 10° C./s when a temperature of a steel sheet is in a range of not less than 600° C. The reason for defining the temperature range of the steel sheet to be not less than 600° C. is that effects of the cooling rate may be practically negligible, because grains grow extremely slowly when the temperature of the steel sheet is less than 600° C.

Five kinds of patterns shown in FIG. 4 are applicable as an annealing pattern after cooling according to the configuration of annealing line. In a line consisting of a cooling zone and an overaging zone in succession after an annealing zone, a first pattern in which cooling is stopped at about predetermined temperature and overaging treatment is directly performed, or a second pattern in which reheating and averaging treatment are performed after annealing may be applied. A fourth pattern corresponds to CGL (hot dip galvanizing line) and is the same as the second pattern except that a final temperature of cooling is defined as a temperature of a molten zinc bath.

The hard second phase only comprises cementite when the annealing temperature Ts is not more than the transformation point Ac1 as is mentioned above. A case in which the annealing temperature Ts and the starting temperature of rapid cooling $T_Q$ are not less than the transformation point Ac1 is explained in detail hereinafter. When the cooling rate is high and a steel is cooled to not more than Ms point without crossing a nose of ferrite deformation and a nose of bainite deformation in the CCT diagram, martensite is obtained as the hard second phase. Martensite is tempered martensite in a precise cense in the first, second and fourth pattern which has an overaging zone. It should be noted that the tempered martensite has high degree of hardness due to the high dislocation density thereof and has large effects on the strengthening of a steel, which is mentioned above, thereby included in martensite without distinction in the present invention.

When cooling is performed at the cooling rate such that temperature thereof crosses the nose of bainite transformation and the final temperature of cooling is set to not more than Ms point, the hard second phase is a complex structure of martensite and bainite. When cooling is stopped and overaging treatment is followed at just above the Ms point in the first, second, and fourth pattern which have an overaging zone, the hard second phase is bainite or a mixed structure of residual austenite and bainite. Whether the residual austenite is produced or not is selected by a stability of austenite at annealing. That is, residual austenite is obtained by increasing amount of alloying element (Si, Al) or time of overaging treatment in order to accelerate condensation of carbon into austenite and stabilize the austenite.

The hard second phase comprises pearlite when the cooling rate is slow and temperature thereof crosses a nose of pearlite deformation. In this case, fine carbides may be included in ferrite. Because the solid-solved carbon in the ferrite at annealing precipitates as cementite which is a metastable phase during cooling.

Specifically, the kind of structures are the same in the first and second pattern. When the annealing temperature Ts and the starting temperature of rapid cooling $T_Q$ are not less than the transformation point Ac1, the hard second phase comprises at least one selected from a group consisting of pearlite, martensite, bainite, and residual austenite. The hard second phase only comprises cementite when the annealing temperature Ts is less than the transformation point Ac1.

A factory line without an overaging zone such as a third annealing pattern finishes when cooling is performed to not more than 100° C. after annealing. In this case, when the annealing temperature Ts and the starting temperature of rapid cooling $T_Q$ are not less than the transformation point Ac1, the hard second phase comprises at least one of pearlite, martensite, and bainite. When the annealing temperature Ts is less than the transformation point Ac1, the hard second phase only comprises cementite.

The fourth annealing pattern corresponds to CGL (hot dip galvanizing line). The surface of a steel is plated with zinc in a molten zinc bath after rapid cooling from annealing temperature. Afterward, the galvanized layer may be alloyed by reheating, or may not be alloyed by skipping the reheating. The kinds of the hard second phase are the same as the case of the first and the second pattern when reheating is performed, and are the same as the case of the third pattern when reheating is not performed.

A fifth annealing pattern is box annealing. If a coil is removed from a furnace casing after box annealing, the annealing temperature is not limited in a condition in which a cooling rate reaches 10° C./s or higher by forced cooling operation. However, generally, the coil is not removed from the furnace casing after annealing and is cooled in the furnace casing. Therefore, the annealing temperature is required to be limited to less than 600° C. because the cooling rate does not reach 10° C./s or higher.

Second Function regarding Effects of the High-Strength Steel Sheet of the Present Invention A function of obtaining a structure of nanograins by ordinary cold rolling is explained hereinafter.

Repeat of laminating and rolling that is mentioned in the beginning and has been conventionally applied is explained. Repeat of laminating and rolling is an effective method for obtaining a structure of nanograins because a large strain is applied to a plate-like sample. For example, the Journal of The Japan Society for Technology of Plasticity (vol. 40, No. 467, p. 1190) discloses an example of aluminum. A subgrain structure having a slight difference of orientation is only obtained when rolling is performed with a lubricated mill roll, and nanograins are obtained when an unlubricated mill roll is used.

This phenomenon occurs because a larger strain is applied when the shear deformation is performed by an unlubricated mill roll than by a lubricated mill roll, and because shear strain is introduced to the inside of a material as a result of a portion which has been a surface at a previous cycle comes to the inside of the material by repeating a cycle of laminating and rolling. That is, although laminating and rolling are repeated, ultrafine grains are not produced unless a large shear strain is introduced to the inside of a material by unlubricated rolling.

The inventors have researched a method for introducing a shear strain to the inside of a material by ordinary oil lubricated rolling without repeating laminating and rolling which have low production efficiency and without unlubricated rolling which applies a large load on the mill roll. As a result, the inventors have found that a structure before rolling should have a complex structure consisting of a soft portion and a hard portion. That is, a steel sheet with a complex structure of a soft ferrite and a hard second phase is cold rolled. The ferrite portion between the hard second phases is shear-deformed by constraint of the hard second phase. Therefore, shear strain is introduced to a large area of the inside of a material.

The inventors have carried out further research and obtained results showing that when rolling is performed until a distance between the second hard phases is a certain value after rolling even though there are various distances between the hard second phases before rolling, shear deformation is introduced to the inside of a material in the same way as the above. That is, when an average distance between the hard second phases of a structure after hot rolling is expressed as d (μm), a sheet thickness after hot rolling (before cold rolling) is expressed as to, and a sheet thickness after cold rolling is expressed as t, cold rolling is found out to be required to be performed in a condition in which reduction index D satisfies the following equation (10).

$$D=d\times t/t_0\leqq 1 \quad (10)$$

Figure 5:
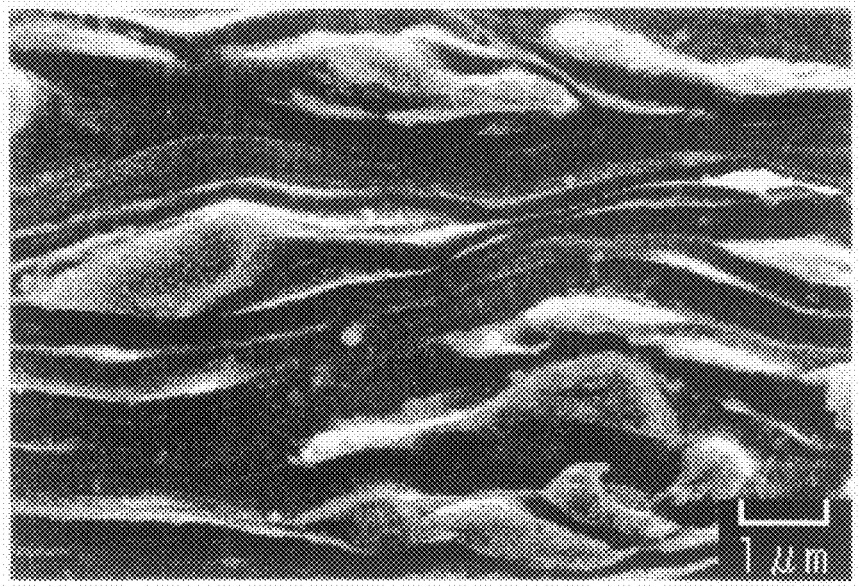
FIG. 5 is a scanning electron microscope (SEM) image showing a structure of a high-strength steel sheet of the present invention after cold rolling.

An example of a SEM image at a magnification ratio of 5000× a cross section parallel to a rolling direction of a steel sheet is shown in FIG. 5. The steel sheet was cold rolled through a series of processes in accordance with a production method of the present invention. A ferrite portion in black between hard second phases (martensite) in white is observed to be shear deformed. A large shear strain is applied to the inside of a steel sheet by ordinary rolling due to the shear deformation, and a structure of nanograins is obtained by the subsequent annealing.

First Embodiment

Slabs (slabs 1 to 19 according to the present invention and comparative slabs 1 to 11), of the chemical compositions are shown in Table 3, were ingoted.

TABLE 3

| chemical compositions | composition C % | Si % | Mn % | P % | S % | Al % | Nb % | Ti % | Cr % | Mo % | Ni % | B % |
|---|---|---|---|---|---|---|---|---|---|---|---|---|
| invented slab 1 | 0.023 | 0.32 | 1.24 | 0.011 | 0.007 | 0.024 | 0.012 | 0.002 | 0.45 | 0.001 | 0.01 | 0.0003 |
| invented slab 2 | 0.080 | 0.42 | 1.84 | 0.035 | 0.004 | 0.089 | 0.002 | 0.014 | 0.04 | 0.001 | 0.01 | 0.0002 |
| invented slab 3 | 0.050 | 0.49 | 1.22 | 0.097 | 0.005 | 0.051 | 0.022 | 0.001 | 0.03 | 0.190 | 0.02 | 0.0001 |
| invented slab 4 | 0.099 | 0.01 | 2.01 | 0.001 | 0.002 | 0.021 | 0.023 | 0.002 | 0.01 | 0.001 | 0.01 | 0.0001 |
| invented slab 5 | 0.098 | 0.01 | 1.53 | 0.001 | 0.002 | 0.028 | 0.002 | 0.001 | 0.01 | 0.001 | 0.02 | 0.0001 |
| invented slab 6 | 0.099 | 0.01 | 2.00 | 0.001 | 0.002 | 0.023 | 0.088 | 0.094 | 0.01 | 0.001 | 0.02 | 0.0012 |
| invented slab 7 | 0.098 | 0.01 | 2.00 | 0.001 | 0.002 | 0.024 | 0.002 | 0.068 | 0.02 | 0.001 | 0.02 | 0.0028 |
| invented slab 8 | 0.102 | 0.17 | 0.80 | 0.012 | 0.005 | 0.028 | 0.001 | 0.001 | 0.01 | 0.001 | 0.01 | 0.0000 |
| invented slab 9 | 0.130 | 0.01 | 0.37 | 0.014 | 0.007 | 0.051 | 0.001 | 0.002 | 0.01 | 0.001 | 0.01 | 0.0000 |
| invented slab 10 | 0.161 | 0.01 | 0.56 | 0.012 | 0.007 | 0.008 | 0.002 | 0.002 | 0.02 | 0.002 | 0.02 | 0.0000 |
| invented slab 11 | 0.170 | 0.44 | 1.32 | 0.012 | 0.005 | 0.028 | 0.002 | 0.001 | 0.01 | 0.002 | 0.01 | 0.0001 |
| invented slab 12 | 0.173 | 0.01 | 0.79 | 0.001 | 0.002 | 0.028 | 0.002 | 0.001 | 0.02 | 0.670 | 0.02 | 0.0001 |
| invented slab 13 | 0.200 | 0.03 | 0.79 | 0.002 | 0.002 | 0.021 | 0.012 | 0.002 | 0.01 | 0.002 | 0.01 | 0.0002 |
| invented slab 14 | 0.205 | 0.02 | 1.50 | 0.001 | 0.002 | 0.022 | 0.002 | 0.002 | 0.01 | 0.001 | 0.02 | 0.0001 |
| invented slab 15 | 0.231 | 0.03 | 0.57 | 0.017 | 0.005 | 0.024 | 0.001 | 0.001 | 0.97 | 0.260 | 0.02 | 0.0000 |
| invented slab 16 | 0.250 | 0.02 | 0.97 | 0.002 | 0.002 | 0.021 | 0.002 | 0.001 | 0.49 | 0.290 | 0.02 | 0.0000 |

TABLE 3-continued

| | | | | | | | | | | | | |
|---|---|---|---|---|---|---|---|---|---|---|---|---|
| invented slab 17 | 0.297 | 0.22 | 0.64 | 0.016 | 0.005 | 0.028 | 0.002 | 0.002 | 1.45 | 0.010 | 0.67 | 0.0001 |
| invented slab 18 | 0.097 | 1.21 | 1.58 | 0.065 | 0.001 | 0.052 | 0.002 | 0.002 | 0.04 | 0.001 | 0.01 | 0.0002 |
| invented slab 19 | 0.147 | 1.55 | 1.67 | 0.011 | 0.004 | 0.035 | 0.003 | 0.001 | 0.01 | 0.001 | 0.01 | 0.0004 |
| comparative slab 1 | 0.230 | 0.03 | 0.59 | 0.011 | 0.004 | 0.034 | 0.001 | 0.002 | 0.02 | 0.002 | 0.01 | 0.0002 |
| comparative slab 2 | 0.340 | 0.62 | 0.85 | 0.014 | 0.007 | 0.030 | 0.001 | 0.001 | 0.02 | 0.001 | 0.01 | 0.0001 |
| comparative slab 3 | 0.360 | 0.29 | 0.68 | 0.011 | 0.014 | 0.028 | 0.002 | 0.001 | 1.09 | 0.070 | 0.08 | 0.0002 |
| comparative slab 4 | 0.002 | 0.30 | 1.53 | 0.036 | 0.007 | 0.052 | 0.001 | 0.001 | 0.52 | 0.001 | 0.02 | 0.0001 |
| comparative slab 5 | 0.050 | 0.01 | 0.37 | 0.014 | 0.004 | 0.028 | 0.001 | 0.001 | 0.01 | 0.002 | 0.01 | 0.0002 |
| comparative slab 6 | 0.070 | 0.01 | 0.78 | 0.017 | 0.005 | 0.039 | 0.002 | 0.001 | 0.02 | 0.002 | 0.01 | 0.0001 |
| comparative slab 7 | 0.050 | 0.50 | 1.22 | 0.097 | 0.005 | 0.051 | 0.053 | 0.132 | 0.52 | 0.193 | 0.01 | 0.0001 |
| comparative slab 8 | 0.050 | 3.05 | 2.55 | 0.063 | 0.005 | 0.050 | 0.001 | 0.001 | 0.02 | 0.001 | 0.02 | 0.0002 |
| comparative slab 9 | 0.099 | 1.05 | 2.01 | 0.188 | 0.002 | 0.137 | 0.023 | 0.002 | 0.01 | 0.001 | 0.02 | 0.0001 |
| comparative slab 10 | 0.099 | 1.05 | 2.01 | 0.001 | 0.002 | 0.049 | 0.003 | 0.002 | 1.95 | 2.520 | 0.02 | 0.0001 |
| comparative slab 11 | 0.096 | 0.02 | 2.01 | 0.002 | 0.002 | 0.024 | 0.093 | 0.151 | 0.01 | 0.001 | 0.01 | 0.0038 |

| chemical compositions | equation (4) $F_1(Q)$ | ≧−40C + 6.0 right-hand side | result | equation (5) $F_1(Q)$ | ≧25C − 2.5 right-hand side | result | equation (9) $F_2(S) + F_3(P)$ ≦360 | result | equation (6) C 0.02~0.03 | result |
|---|---|---|---|---|---|---|---|---|---|---|
| invented slab 1 | 5.56 | 5.16 | OK | 5.56 | −1.93 | OK | 180 | OK | 0.021 | OK |
| invented slab 2 | 6.46 | 2.95 | OK | 6.46 | −0.50 | OK | 280 | OK | 0.076 | OK |
| invented slab 3 | 4.80 | 4.12 | OK | 4.80 | −1.25 | OK | 235 | OK | 0.047 | OK |
| invented slab 4 | 6.46 | 2.18 | OK | 6.46 | −0.02 | OK | 220 | OK | 0.096 | OK |
| invented slab 5 | 4.97 | 2.10 | OK | 4.98 | −0.05 | OK | 163 | OK | 0.097 | OK |
| invented slab 6 | 8.63 | 3.44 | OK | 8.63 | −0.02 | OK | 345 | OK | 0.064 | OK |
| invented slab 7 | 11.9 | 2.77 | OK | 11.85 | −0.05 | OK | 279 | OK | 0.081 | OK |
| invented slab 8 | 2.62 | 1.94 | OK | 2.62 | 0.05 | OK | 111 | OK | 0.102 | OK |
| invented slab 9 | 1.18 | 0.83 | OK | 1.18 | 0.75 | OK | 59 | OK | 0.129 | OK |
| invented slab 10 | 1.79 | −0.41 | OK | 1.79 | 1.53 | OK | 65 | OK | 0.160 | OK |
| invented slab 11 | 4.61 | −0.78 | OK | 4.61 | 1.75 | OK | 193 | OK | 0.169 | OK |
| invented slab 12 | 4.24 | −0.90 | OK | 4.24 | 1.83 | OK | 128 | OK | 0.172 | OK |
| invented slab 13 | 2.90 | −1.92 | OK | 2.90 | 2.50 | OK | 97 | OK | 0.198 | OK |
| invented slab 14 | 4.89 | −2.17 | OK | 4.89 | 2.63 | OK | 160 | OK | 0.204 | OK |
| invented slab 15 | 4.33 | −3.22 | OK | 4.33 | 3.28 | OK | 95 | OK | 0.231 | OK |
| invented slab 16 | 4.67 | −3.98 | OK | 4.67 | 3.75 | OK | 127 | OK | 0.249 | OK |
| invented slab 17 | 5.45 | −5.85 | OK | 5.45 | 4.93 | OK | 121 | OK | 0.296 | OK |
| invented slab 18 | 6.17 | 2.15 | OK | 6.17 | −0.07 | OK | 325 | OK | 0.096 | OK |
| invented slab 19 | 7.01 | 0.15 | OK | 7.01 | 1.18 | OK | 355 | OK | 0.146 | OK |
| comparative slab 1 | 2.30 | −3.17 | OK | 2.30 | 3.25 | NG | 78 | OK | 0.229 | OK |
| comparative slab 2 | 3.28 | −7.58 | — | 3.28 | 6.00 | — | 168 | OK | 0.340 | OK |
| comparative slab 3 | 5.06 | −8.38 | — | 5.06 | 6.50 | — | 127 | OK | 0.359 | OK |
| comparative slab 4 | 6.19 | 5.94 | — | 6.19 | −2.45 | — | 215 | OK | 0.002 | NG |
| comparative slab 5 | 1.58 | 4.02 | NG | 1.58 | −1.25 | OK | 51 | OK | 0.050 | OK |
| comparative slab 6 | 2.67 | 3.22 | NG | 2.67 | −0.75 | OK | 96 | OK | 0.069 | OK |
| comparative slab 7 | 5.79 | 5.60 | OK | 5.79 | −1.25 | OK | 387 | NG | 0.010 | NG |
| comparative slab 8 | 10.3 | 4.02 | OK | 10.3 | −1.25 | OK | 624 | NG | 0.050 | OK |
| comparative slab 9 | 7.14 | 2.18 | OK | 7.14 | −0.02 | OK | 414 | NG | 0.096 | OK |
| comparative slab 10 | 16.8 | 2.08 | OK | 16.8 | −0.02 | OK | 494 | NG | 0.098 | OK |
| comparative slab 11 | 13.9 | 4.15 | OK | 13.9 | −0.10 | OK | 411 | NG | 0.046 | OK |

※The unit of each composition is mass % which is shown as % in the table for simplification.

Hot-rolled steel sheets were produced by using these slabs under conditions shown in Tables 4A and 4B, and then, steel sheets (practical examples 1 to 26 and comparative examples 1 to 26) comprising annealed structures shown in Tables 6A and 6B were obtained by cold rolling and annealing under conditions shown in Tables 5A and 5B.

TABLE 4A

| | compositions symbols | hot rolling: heating temperature T1 ° C. | heating time t1 minute | cooling rate R1 ° C./s | temperature when rolling is finished T2 ° C. | cooling rate R2 ° C./s | maintaining temperature T3 ° C. | main-taining time t2 second | cooling rate R3 ° C./s | winding temperature T4 ° C. |
|---|---|---|---|---|---|---|---|---|---|---|
| | standard | | | | | | | | | |
| practical example 1 | invented slab 1 | 1000 | 60 | 31 | 823 | 32 | 759 | 5 | 126 | room temperature |
| practical example 2 | invented slab 2 | 1200 | 60 | 12 | 792 | 29 | 705 | 5 | 116 | room temperature |
| practical example 3 | invented slab 2 | 1200 | 60 | 12 | 792 | 29 | 705 | 5 | 116 | room temperature |

TABLE 4A-continued

| | | | | | | | | | | |
|---|---|---|---|---|---|---|---|---|---|---|
| practical example 4 | invented slab 2 | 1200 | 60 | 10 | 801 | 27 | 738 | 5 | 121 | room temperature |
| practical example 5 | invented slab 2 | 1200 | 60 | 10 | 798 | 2 | 776 | 0 | 134 | room temperature |
| practical example 6 | invented slab 3 | 950 | 30 | 3 | 839 | 32 | 744 | 5 | 93 | room temperature |
| practical example 7 | invented slab 4 | 950 | 30 | 3 | 827 | 28 | 657 | 5 | 115 | room temperature |
| practical example 8 | invented slab 4 | 950 | 30 | 3 | 827 | 28 | 657 | 5 | 116 | room temperature |
| practical example 9 | invented slab 4 | 950 | 30 | 51 | 769 | 2 | 765 | 5 | 132 | room temperature |
| practical example 10 | invented slab 5 | 950 | 30 | 3 | 831 | 29 | 697 | 5 | 59 | room temperature |
| practical example 11 | invented slab 6 | 950 | 30 | 3 | 831 | 29 | 697 | 5 | 57 | room temperature |
| practical example 12 | invented slab 7 | 950 | 30 | 3 | 706 | 1 | 551 | 0 | 129 | room temperature |
| practical example 13 | invented slab 7 | 950 | 30 | 3 | 706 | 1 | 551 | 0 | 129 | room temperature |
| practical example 14 | invented slab 8 | 950 | 30 | 48 | 823 | 30 | 734 | 5 | 134 | room temperature |
| practical example 15 | invented slab 9 | 950 | 30 | 52 | 805 | 26 | 728 | 5 | 131 | room temperature |
| practical example 16 | invented slab 10 | 950 | 30 | 51 | 812 | 29 | 725 | 5 | 121 | room temperature |
| practical example 17 | invented slab 11 | 950 | 30 | 29 | 786 | 13 | 698 | 10 | 89 | room temperature |
| practical example 18 | invented slab 12 | 1100 | 30 | 28 | 758 | 10 | 718 | 5 | 106 | room temperature |
| practical example 19 | invented slab 13 | 1200 | 60 | 5 | 723 | 12 | 654 | 5 | 108 | room temperature |
| practical example 20 | invented slab 14 | 1200 | 60 | 5 | 788 | 29 | 689 | 5 | 85 | room temperature |
| practical example 21 | invented slab 15 | 900 | 60 | 1 | 768 | 12 | 667 | 5 | 98 | reheating from room tempeature to 500° C. |
| practical example 22 | invented slab 16 | 900 | 60 | 1 | 752 | 10 | 689 | 5 | 94 | room temperature |
| practical example 23 | invented slab 17 | 900 | 60 | 1 | 731 | 11 | 658 | 5 | 91 | room temperature |
| practical example 24 | invented slab 18 | 950 | 30 | 27 | 811 | 30 | 671 | 30 | 30 | 336 |
| practical example 25 | invented slab 18 | 950 | 30 | 27 | 811 | 30 | 671 | 30 | 30 | 336 |
| practical example 26 | invented slab 19 | 950 | 30 | 10 | 785 | 33 | 702 | 30 | 29 | 331 |

| | hot rolling | | | | | | |
|---|---|---|---|---|---|---|---|
| | maintaining time | cooling rate | final sheet | structure | | distance between second | average area ratio |
| | t3 minute | R4 ° C./s | thickness mm | main phase | second phase | phases d μm | of second phase % |
| | | | | F | M, B, A | | |
| practical example 1 | — | — | 5.0 | F | M | 4.8 | 10.8 |
| practical example 2 | — | — | 6.0 | F | M | 3.4 | 11.4 |
| practical example 3 | — | — | 6.0 | F | M | 3.4 | 11.4 |
| practical example 4 | — | — | 6.0 | F | M | 3.3 | 42.6 |
| practical example 5 | — | — | 4.0 | F | M | 3.8 | 82.2 |
| practical example 6 | — | — | 6.0 | F | M | 4.6 | 20.4 |
| practical example 7 | — | — | 6.0 | F | M | 3.2 | 16.1 |
| practical example 8 | — | — | 6.0 | F | M | 3.2 | 16.1 |
| practical example 9 | — | — | 4.0 | F | M | 2.6 | 19.7 |
| practical example 10 | — | — | 6.0 | F | B | 4.8 | 45.6 |
| practical example 11 | — | — | 8.0 | F | B | 4.7 | 52.2 |
| practical example 12 | — | — | 4.0 | F | M | 3.7 | 12.3 |
| practical example 13 | — | — | 4.0 | F | M | 3.7 | 12.3 |
| practical example 14 | — | — | 4.0 | F | B, M | 4.7 | 13.2 |
| practical example 15 | — | — | 4.0 | F | B, M | 4.8 | 10.3 |
| practical example 16 | — | — | 5.0 | F | M | 4.4 | 11.5 |
| practical example 17 | — | — | 8.0 | F | B, M | 4.1 | 14.4 |
| practical example 18 | — | — | 6.0 | F | B, M | 3.8 | 18.2 |
| practical example 19 | — | — | 6.0 | F | B, M | 3.5 | 14.6 |
| practical example 20 | — | — | 8.0 | F | B, M | 3.3 | 16.5 |
| practical example 21 | 30 | 5.8 | 8.0 | F | M | 4.2 | 38.9 |
| practical example 22 | — | — | 8.0 | F | B, M | 4.1 | 45.6 |
| practical example 23 | — | — | 8.0 | F | B, M | 4.4 | 46.9 |
| practical example 24 | 30 | 5.1 | 8.0 | F | B, A | 3.4 | 32.4 |
| practical example 25 | 30 | 5.1 | 8.0 | F | B, A | 3.4 | 32.4 |
| practical example 26 | 30 | 5.5 | 8.0 | F | B, A | 3.2 | 35.6 |

P: pearlite
C: cementite
M: martensite
B: bainite
A: residual austenite

TABLE 4B

| | compositions symbols | hot rolling | | | | | | | | |
|---|---|---|---|---|---|---|---|---|---|---|
| | | heating temperature T1 ° C. | heating time t1 minute | cooling rate R1 ° C./s | temperature when rolling is finished T2 ° C. | cooling rate R2 ° C./s | maintaining temperature T3 ° C. | main-taining time t2 second | cooling rate R3 ° C./s | winding temperature T4 ° C. |
| | standard invented slab 6 | 1100 | 30 | 3 | 770 | 2 | 700 | 600 | 31 | room temperature |
| comparative example 1 | invented slab 4 | 1100 | 30 | 3 | 770 | 2 | 700 | 600 | 33 | room temperature |
| comparative example 2 | invented slab 2 | 1200 | 60 | 12 | 792 | 29 | 705 | 5 | 116 | room temperature |
| comparative example 3 | invented slab 2 | 1200 | 60 | 12 | 792 | 29 | 705 | 5 | 116 | room temperature |
| comparative example 4 | invented slab 3 | 1100 | 30 | 3 | 764 | 2 | 710 | 600 | 31 | room temperature |
| comparative example 5 | invented slab 3 | 1100 | 30 | 3 | 745 | 2 | 700 | 600 | 33 | room temperature |
| comparative example 6 | invented slab 11 | 1100 | 30 | 3 | 834 | 18 | — | — | — | 587 |
| comparative example 7 | invented slab 11 | 1100 | 30 | 3 | 834 | 18 | — | — | — | 587 |
| comparative example 8 | invented slab 11 | 1100 | 30 | 3 | 834 | 18 | — | — | — | 587 |
| comparative example 9 | invented slab 11 | 950 | 30 | 3 | 834 | 18 | — | — | — | 587 |
| comparative example 10 | invented slab 5 | 1100 | 30 | 3 | 775 | 2 | 700 | 600 | 32 | room temperature |
| comparative example 11 | invented slab 5 | 1100 | 30 | 3 | 775 | 2 | 700 | 600 | 2.2 | room temperature |
| comparative example 12 | invented slab 6 | 1100 | 30 | 3 | 700 | 2 | 700 | 600 | 31 | room temperature |
| comparative example 13 | invented slab 6 | 1100 | 30 | 3 | 700 | 2 | 700 | 600 | 31 | room temperature |
| comparative example 14 | invented slab 18 | 950 | 30 | 27 | 811 | 30 | 671 | 30 | 30 | 336 |
| comparative example 15 | comparative slab 1 | 1100 | 30 | 12 | 857 | 29 | — | — | — | 622 |
| comparative example 16 | comparative slab 2 | 1100 | 30 | 10 | 834 | 5 | 723 | 10 | 27 | room temperature |
| comparative example 17 | comparative slab 3 | 1100 | 30 | 5 | 736 | 5 | 689 | 60 | 29 | room temperature |
| comparative example 18 | comparative slab 4 | 1200 | 60 | 3 | 932 | 29 | — | — | — | 758 |
| comparative example 19 | comparative slab 5 | 1200 | 60 | 12 | 885 | 31 | — | — | — | 578 |
| comparative example 20 | comparative slab 6 | 1200 | 60 | 3 | 873 | 29 | — | — | — | 584 |
| comparative example 21 | comparative slab 7 | 1250 | 60 | 10 | 825 | 30 | 736 | 5 | 50 | room temperature |
| comparative example 22 | comparative slab 8 | 950 | 30 | 3 | 827 | 31 | 702 | 5 | 88 | room temperature |
| comparative example 23 | comparative slab 9 | 950 | 30 | 3 | 821 | 33 | 657 | 5 | 92 | room temperature |
| comparative example 24 | comparative slab 10 | 950 | 30 | 3 | 721 | 11 | 562 | 10 | 96 | room temperature |
| comparative example 25 | comparative slab 11 | 1200 | 60 | 3 | 718 | 12 | 548 | 10 | 91 | room temperature |
| comparative example 26 | | | | | | | | | | |

| | hot rolling | | | | | | |
|---|---|---|---|---|---|---|---|
| | maintaining time | cooling rate | final sheet | structure | | distance between second | average area ratio |
| | t3 minute | R4 ° C./s | thickness mm | main phase | second phase | phases d μm | of second phase % |
| | | | | F | M, B, A | | |
| comparative example 1 | — | — | 6.0 | F | B | 5.2 | 58.2 |
| comparative example 2 | — | — | 6.0 | F | B | 8.1 | 49.1 |
| comparative example 3 | — | — | 6.0 | F | M | 3.4 | 11.4 |

TABLE 4B-continued

| | | | | | | | |
|---|---|---|---|---|---|---|---|
| comparative example 4 | — | — | 6.0 | F | M | 3.4 | 11.4 |
| comparative example 5 | — | — | 10.0 | F | B | 13.9 | 15.8 |
| comparative example 6 | — | — | 10.0 | F | B | 24.4 | 18.9 |
| comparative example 7 | 60 | 4.9 | 10.0 | F | P | 9.8 | 18.7 |
| comparative example 8 | 60 | 4.9 | 10.0 | F | P | 9.8 | 18.7 |
| comparative example 9 | 60 | 4.9 | 10.0 | F | P | 9.8 | 18.7 |
| comparative example 10 | 60 | 4.9 | 10.0 | F | P | 9.8 | 18.7 |
| comparative example 11 | — | — | 6.0 | F | B | 5.2 | 58.2 |
| comparative example 12 | — | — | 6.0 | F | P | 13.8 | 45.6 |
| comparative example 13 | — | — | 6.0 | F | B | 5.2 | 58.2 |
| comparative example 14 | — | — | 6.0 | F | B | 5.2 | 58.2 |
| comparative example 15 | 30 | 5.1 | 8.0 | F | B, A | 3.4 | 32.4 |
| comparative example 16 | 60 | 4.6 | 8.0 | F | P | 8.8 | 58.6 |
| comparative example 17 | — | — | 6.0 | F | P | 7.2 | 48.8 |
| comparative example 18 | — | — | 6.0 | F | P, B | 6.4 | 89.9 |
| comparative example 19 | 60 | 5 | 13.0 | F | — | — | — |
| comparative example 20 | 60 | 5 | 8.0 | F | — | — | — |
| comparative example 21 | 60 | 5 | 8.0 | F | P | 8.9 | 2.3 |
| comparative example 22 | — | — | 8.0 | F | C | 4.8 | 1.6 |
| comparative example 23 | — | — | 8.0 | F | M | 6.8 | 18.6 |
| comparative example 24 | — | — | 8.0 | F | M | 7.8 | 17.8 |
| comparative example 25 | — | — | 8.0 | F | M | 5.5 | 15.7 |
| comparative example 26 | — | — | 8.0 | F | M | 3.6 | 13.4 |

P: pearlite
C: cementite
M: martensite
B: bainite
A: residual austenite

TABLE 5A

| | | cold rolling conditions | | | | annealing conditions | |
|---|---|---|---|---|---|---|---|
| | compositions symbols | sheet thickness mm | rolling rate % | rolling temperature ° C. | index of workability D | pattern | annealing temperature T ° C. |
| | standard | | | | ≦1.0 | | |
| practical example 1 | invented slab 1 | 1.0 | 80 | room temperature | 0.96 | 3 | 625 |
| practical example 2 | invented slab 2 | 1.2 | 80 | 186 | 0.68 | 3 | 668 |
| practical example 3 | invented slab 2 | 1.5 | 75 | 180 | 0.85 | 5 | 550 |
| practical example 4 | invented slab 2 | 1.8 | 70 | room temperature | 0.99 | 3 | 650 |
| practical example 5 | invented slab 2 | 1.0 | 75 | room temperature | 0.95 | 3 | 700 |
| practical example 6 | invented slab 3 | 1.2 | 80 | room temperature | 0.92 | 3 | 678 |
| practical example 7 | invented slab 4 | 1.5 | 75 | room temperature | 0.80 | 1 | 676 |
| practical example 8 | invented slab 4 | 1.5 | 75 | room temperature | 0.80 | 1 | 702 |
| practical example 9 | invented slab 4 | 1.5 | 63 | room temperature | 0.96 | 3 | 652 |
| practical example 10 | invented slab 5 | 1.2 | 80 | room temperature | 0.96 | 5 | 625 |
| practical example 11 | invented slab 6 | 1.6 | 80 | room temperature | 0.94 | 3 | 700 |
| practical example 12 | invented slab 7 | 1.0 | 75 | room temperature | 0.93 | 1 | 606 |
| practical example 13 | invented slab 7 | 1.0 | 75 | room temperature | 0.93 | 1 | 639 |
| practical example 14 | invented slab 8 | 0.8 | 80 | room temperature | 0.94 | 4 | 675 |
| practical example 15 | invented slab 9 | 0.8 | 80 | room temperature | 0.96 | 4 | 675 |

TABLE 5A-continued

| | | | | | | | |
|---|---|---|---|---|---|---|---|
| practical example 16 | invented slab 10 | 1.0 | 80 | room temperature | 0.88 | 4 | 675 |
| practical example 17 | invented slab 11 | 1.6 | 80 | room temperature | 0.82 | 3 | 675 |
| practical example 18 | invented slab 12 | 1.5 | 75 | room temperature | 0.95 | 3 | 675 |
| practical example 19 | invented slab 13 | 1.5 | 75 | room temperature | 0.88 | 3 | 725 |
| practical example 20 | invented slab 14 | 2.0 | 75 | room temperature | 0.83 | 2 | 650 |
| practical example 21 | invented slab 15 | 1.6 | 80 | room temperature | 0.84 | 2 | 675 |
| practical example 22 | invented slab 16 | 1.6 | 80 | room temperature | 0.82 | 2 | 702 |
| practical example 23 | invented slab 17 | 1.6 | 80 | room temperature | 0.88 | 2 | 700 |
| practical example 24 | invented slab 18 | 2.0 | 75 | room temperature | 0.85 | 1 | 745 |
| practical example 25 | invented slab 18 | 2.0 | 75 | 254 | 0.85 | 1 | 650 |
| practical example 26 | invented slab 19 | 2.0 | 75 | room temperature | 0.80 | 1 | 745 |

| | annealing conditions | | | | | | |
|---|---|---|---|---|---|---|---|
| | maintaining time t second | T + 40 · log(t) | start temperature of cooling ° C. | cooling method | cooling rate ° C./s | overaging temperature ° C. | time second |
| | | 680~770 | | | ≧10 (T ≧ 700° C.) | | |
| practical example 1 | 120 | 708 | 610 | WQ | 246 | — | — |
| practical example 2 | 2 | 680 | 663 | WQ | 223 | — | — |
| practical example 3 | 3600 | 692 | 550 | gas | 4.8 | — | — |
| practical example 4 | 20 | 702 | 645 | WQ | 145 | — | — |
| practical example 5 | 5 | 728 | 695 | WQ | 196 | — | — |
| practical example 6 | 10 | 718 | 663 | WQ | 175 | — | — |
| practical example 7 | 20 | 728 | 665 | spraying with water | 54 | 250 | 120 |
| practical example 8 | 20 | 754 | 675 | spraying with water | 52 | 250 | 120 |
| practical example 9 | 10 | 692 | 642 | WQ | 188 | — | — |
| practical example 10 | 600 | 736 | 615 | gas | 12 | — | — |
| practical example 11 | 20 | 752 | 690 | gas | 11 | — | — |
| practical example 12 | 120 | 689 | 591 | spraying with water | 58 | 250 | 180 |
| practical example 13 | 20 | 691 | 624 | spraying with water | 63 | 250 | 180 |
| practical example 14 | 20 | 727 | 665 | gas | 20 | 515 | 20 |
| practical example 15 | 20 | 727 | 665 | gas | 19 | 500 | 20 |
| practical example 16 | 20 | 727 | 665 | gas | 22 | 510 | 20 |
| practical example 17 | 20 | 727 | 660 | WQ | 175 | — | — |
| practical example 18 | 20 | 727 | 660 | WQ | 185 | — | — |
| practical example 19 | 2 | 737 | 710 | gas | 12 | — | — |
| practical example 20 | 20 | 702 | 635 | WQ | 134 | 275 | 180 |
| practical example 21 | 20 | 727 | 660 | WQ | 165 | 275 | 180 |
| practical example 22 | 10 | 742 | 687 | WQ | 156 | 225 | 30 |
| practical example 23 | 10 | 740 | 685 | WQ | 163 | 225 | 30 |
| practical example 24 | 2 | 757 | 735 | gas | 30 | 400 | 180 |
| practical example 25 | 10 | 690 | 640 | gas | 31 | 250 | 120 |
| practical example 26 | 2 | 757 | 735 | gas | 32 | 380 | 120 |

WQ: Water quenching

TABLE 5B

| | | cold rolling conditions | | | | annealing conditions | |
|---|---|---|---|---|---|---|---|
| | compositions symbols | sheet thickness mm | rolling rate % | rolling temperature ° C. | index of workability D | pattern | annealing temperature T ° C. |
| | standard | | | | ≦1.0 | | |
| comparative example 1 | invented slab 6 | 0.6 | 90 | 255 | 0.52 | 1 | 655 |
| comparative example 2 | invented slab 4 | 0.6 | 90 | room temperature | 0.81 | 1 | 653 |
| comparative example 3 | invented slab 2 | 1.2 | 80 | room temperature | 0.68 | 3 | 808 |
| comparative example 4 | invented slab 2 | 1.2 | 80 | 186 | 0.68 | 3 | 602 |
| comparative example 5 | invented slab 3 | 1.0 | 90 | room temperature | 1.39 | 1 | 725 |
| comparative example 6 | invented slab 3 | 1.0 | 90 | 211 | 2.44 | 1 | 677 |
| comparative example 7 | invented slab 11 | 0.5 | 95 | room temperature | 0.49 | 5 | 680 |
| comparative example 8 | invented slab 11 | 1.0 | 90 | room temperature | 0.98 | 5 | 550 |
| comparative example 9 | invented slab 11 | 1.0 | 90 | room temperature | 0.98 | 5 | 680 |
| comparative example 10 | invented slab 11 | 1.5 | 85 | room temperature | 1.47 | 5 | 550 |

TABLE 5B-continued

| | | | | | | | |
|---|---|---|---|---|---|---|---|
| comparative example 11 | invented slab 5 | 1.2 | 80 | 255 | 1.04 | 3 | 753 |
| comparative example 12 | invented slab 5 | 1.5 | 75 | room temperature | 3.45 | 3 | 857 |
| comparative example 13 | invented slab 6 | 1.8 | 70 | 258 | 1.56 | 1 | 654 |
| comparative example 14 | invented slab 6 | 1.3 | 78 | 235 | 1.14 | 1 | 653 |
| comparative example 15 | invented slab 18 | 2.0 | 60 | 251 | 1.36 | 1 | 775 |
| comparative example 16 | comparative slab 1 | 1.2 | 85 | room temperature | 1.32 | 3 | 680 |
| comparative example 17 | comparative slab 2 | 1.8 | 70 | room temperature | 2.16 | 3 | 700 |
| comparative example 18 | comparative slab 3 | 0.9 | 85 | room temperature | 0.96 | 3 | 725 |
| comparative example 19 | comparative slab 4 | 0.9 | 93 | room temperature | — | 5 | 675 |
| comparative example 20 | comparative slab 5 | 0.8 | 90 | room temperature | — | 3 | 700 |
| comparative example 21 | comparative slab 6 | 0.8 | 90 | room temperature | 0.89 | 3 | 700 |
| comparative example 22 | comparative slab 7 | 0.8 | 90 | room temperature | 0.48 | 3 | 750 |
| comparative example 23 | comparative slab 8 | 1.0 | 88 | room temperature | 0.82 | 3 | 705 |
| comparative example 24 | comparative slab 9 | 1.0 | 88 | room temperature | 0.94 | 3 | 703 |
| comparative example 25 | comparative slab 10 | 1.2 | 85 | room temperature | 0.83 | 3 | 708 |
| comparative example 26 | comparative slab 11 | 1.6 | 80 | room temperature | 0.72 | 3 | 702 |

| | annealing conditions | | | | | | |
|---|---|---|---|---|---|---|---|
| | maintaining time t second | T + 40 · log(t) | start temperature of cooling ° C. | cooling method | cooling rate ° C./s | overaging temperature ° C. | time second |
| | | 680~770 | | | ≧10 (T ≧ 700° C.) | | |
| comparative example 1 | 20 | 707 | 640 | spraying with water | 76 | — | — |
| comparative example 2 | 20 | 705 | 638 | spraying with water | 89 | — | — |
| comparative example 3 | 120 | 891 | 793 | WQ | 215 | — | — |
| comparative example 4 | 2 | 614 | 587 | WQ | 195 | — | — |
| comparative example 5 | 10 | 765 | 710 | spraying with water | 58 | 250 | 120 |
| comparative example 6 | 10 | 717 | 662 | spraying with water | 62 | 250 | 120 |
| comparative example 7 | 60 | 751 | 670 | gas | 4.8 | — | — |
| comparative example 8 | 3600 | 692 | 540 | gas | 18.9 | — | — |
| comparative example 9 | 60 | 751 | 670 | gas | 17.8 | — | — |
| comparative example 10 | 3600 | 692 | 540 | gas | 4.9 | — | — |
| comparative example 11 | 20 | 805 | 738 | spraying with water | 89 | — | — |
| comparative example 12 | 10 | 897 | 847 | gas | 5.1 | — | — |
| comparative example 13 | 20 | 706 | 639 | spraying with water | 46 | — | — |
| comparative example 14 | 20 | 705 | 638 | spraying with water | 57 | — | — |
| comparative example 15 | 5 | 803 | 760 | spraying with water | 54 | — | — |
| comparative example 16 | 20 | 732 | 665 | WQ | 216 | — | — |
| comparative example 17 | 120 | 783 | 690 | gas | 4.8 | — | — |
| comparative example 18 | 10 | 765 | 710 | gas | 12 | — | — |
| comparative example 19 | 1800 | 805 | 665 | gas | 11 | — | — |
| comparative example 20 | 20 | 752 | 685 | WQ | 267 | — | — |
| comparative example 21 | 20 | 752 | 685 | WQ | 256 | — | — |

TABLE 5B-continued

| | | | | | | | |
|---|---|---|---|---|---|---|---|
| comparative example 22 | 10 | 790 | 735 | WQ | 289 | — | — |
| comparative example 23 | 20 | 757 | 690 | WQ | 276 | — | — |
| comparative example 24 | 20 | 755 | 688 | WQ | 267 | — | — |
| comparative example 25 | 20 | 760 | 693 | WQ | 223 | — | — |
| comparative example 26 | 10 | 742 | 687 | WQ | 188 | — | — |

WQ: Water quenching

TABLE 6A

| | | annealed structure | | | | | | | | |
|---|---|---|---|---|---|---|---|---|---|---|
| | | | | area ratio of second phase | | | ferrite | | | |
| | compositions symbols | main phase | second phase | average of area ratio A(ave) % | standard deviations | s/A(ave) | rate of nano grains % | average grain sizes dL (micro grains) | average grain sizes ds (nano grains) | dL/ds |
| | standard | F | P, M, B, A, C | 3~30 | | ≦0.60 | | | | ≧3.0 |
| practical example 1 | invented slab 1 | F | C | 3.1 | 1.5 | 0.48 | 28 | 0.45 | 1.49 | 3.3 |
| practical example 2 | invented slab 2 | F | C | 3.2 | 1.7 | 0.53 | 79 | 0.47 | 1.43 | 3.1 |
| practical example 3 | invented slab 2 | F | C | 5.5 | 2.3 | 0.42 | 88 | 0.67 | 2.21 | 3.3 |
| practical example 4 | invented slab 2 | F | M, C | 28.9 | 5.6 | 0.19 | 47 | 0.52 | 1.68 | 3.2 |
| practical example 5 | invented slab 2 | F | M | 22.5 | 4.6 | 0.20 | 56 | 0.54 | 1.88 | 3.5 |
| practical example 6 | invented slab 3 | F | C | 3.5 | 1.4 | 0.40 | 31 | 0.46 | 1.59 | 3.5 |
| practical example 7 | invented slab 4 | F | C | 4.3 | 2.1 | 0.49 | 26 | 0.52 | 2.23 | 4.3 |
| practical example 8 | invented slab 4 | F | M | 12.6 | 6.5 | 0.52 | 67 | 0.69 | 2.67 | 3.9 |
| practical example 9 | invented slab 4 | F | C | 5.3 | 2.3 | 0.43 | 48 | 0.45 | 1.75 | 3.9 |
| practical example 10 | invented slab 5 | F | C | 4.4 | 1.9 | 0.43 | 22 | 0.59 | 2.46 | 4.2 |
| practical example 11 | invented slab 6 | F | M, C | 8.3 | 2.4 | 0.28 | 15 | 0.53 | 1.78 | 3.4 |
| practical example 12 | invented slab 7 | F | C | 5.8 | 2.3 | 0.40 | 55 | 0.39 | 2.23 | 5.7 |
| practical example 13 | invented slab 7 | F | C | 3.4 | 1.6 | 0.47 | 28 | 0.64 | 3.69 | 5.8 |
| practical example 14 | invented slab 8 | F | C | 4.9 | 2.2 | 0.45 | 25 | 0.56 | 2.34 | 4.2 |
| practical example 15 | invented slab 9 | F | C | 5.6 | 1.9 | 0.34 | 22 | 0.65 | 2.76 | 4.2 |
| practical example 16 | invented slab 10 | F | C | 7.2 | 2.4 | 0.33 | 25 | 0.58 | 2.65 | 4.6 |
| practical example 17 | invented slab 11 | F | C | 8.8 | 2.2 | 0.25 | 36 | 0.49 | 2.34 | 4.8 |
| practical example 18 | invented slab 12 | F | C | 8.6 | 2.3 | 0.27 | 28 | 0.52 | 2.53 | 4.9 |
| practical example 19 | invented slab 13 | F | P, B | 9.5 | 3.4 | 0.36 | 36 | 0.56 | 2.56 | 4.6 |
| practical example 20 | invented slab 14 | F | C | 9.4 | 3.4 | 0.36 | 42 | 0.49 | 2.45 | 5.0 |
| practical example 21 | invented slab 15 | F | C | 10.2 | 3.8 | 0.37 | 38 | 0.65 | 2.66 | 4.1 |
| practical example 22 | invented slab 16 | F | M, C | 15.4 | 6.6 | 0.43 | 54 | 0.76 | 2.89 | 3.8 |
| practical example 23 | invented slab 17 | F | M | 18.8 | 9.7 | 0.52 | 66 | 0.69 | 2.76 | 4.0 |
| practical example 24 | invented slab 18 | F | B, A | 12.8 | 6.8 | 0.53 | 19 | 0.55 | 1.76 | 3.2 |
| practical example 25 | invented slab 18 | F | C | 7.9 | 2.6 | 0.33 | 25 | 0.46 | 1.64 | 3.6 |
| practical example 26 | invented slab 19 | F | B, A | 15.6 | 5.6 | 0.36 | 34 | 0.47 | 1.62 | 3.4 |

| | material properties | | | | | |
|---|---|---|---|---|---|---|
| | static TS MPa | static 3-5% deformation stress σs MPa | static elongation El % | dynamic 3-5% deformation stress σd MPa | difference between static and dynamic stresses Δσ | absorption energy AE MJ/m$^3$ |
| | | | | | ≧170 | |
| practical example 1 | 512 | 447 | 31 | 663 | 216 | 29.6 |
| practical example 2 | 770 | 670 | 27 | 931 | 261 | 43.0 |
| practical example 3 | 771 | 766 | 25 | 952 | 186 | 42.2 |
| practical example 4 | 823 | 732 | 22 | 956 | 224 | 43.3 |
| practical example 5 | 805 | 715 | 24 | 932 | 217 | 42.2 |
| practical example 6 | 648 | 632 | 30 | 845 | 213 | 37.0 |
| practical example 7 | 697 | 683 | 28 | 875 | 192 | 39.3 |
| practical example 8 | 896 | 863 | 19 | 1111 | 248 | 46.4 |
| practical example 9 | 672 | 652 | 27 | 833 | 181 | 37.7 |
| practical example 10 | 644 | 578 | 28 | 763 | 185 | 33.4 |
| practical example 11 | 607 | 572 | 34 | 767 | 194 | 33.1 |
| practical example 12 | 695 | 682 | 26 | 910 | 228 | 39.0 |
| practical example 13 | 547 | 505 | 34 | 682 | 177 | 31.3 |
| practical example 14 | 451 | 414 | 37 | 601 | 187 | 26.6 |

TABLE 6A-continued

| | | | | | | |
|---|---|---|---|---|---|---|
| practical example 15 | 412 | 376 | 42 | 587 | 211 | 26.4 |
| practical example 16 | 443 | 405 | 40 | 611 | 206 | 27.1 |
| practical example 17 | 565 | 532 | 33 | 743 | 211 | 32.3 |
| practical example 18 | 479 | 445 | 35 | 634 | 189 | 28.4 |
| practical example 19 | 497 | 446 | 32 | 661 | 215 | 27.8 |
| practical example 20 | 523 | 489 | 30 | 723 | 234 | 28.9 |
| practical example 21 | 724 | 689 | 24 | 886 | 197 | 38.8 |
| practical example 22 | 845 | 765 | 23 | 963 | 198 | 43.1 |
| practical example 23 | 887 | 803 | 23 | 985 | 182 | 44.1 |
| practical example 24 | 726 | 651 | 29 | 823 | 172 | 38.7 |
| practical example 25 | 685 | 622 | 27 | 803 | 181 | 38.1 |
| practical example 26 | 889 | 807 | 25 | 986 | 179 | 44.2 |

P: pearlite
C: cementite
M: martensite
B: bainite
A: residual austenite

TABLE 6B

| | | annealed structure | | | | | | | | |
|---|---|---|---|---|---|---|---|---|---|---|
| | | | | area ratio of second phase | | | ferrite | | | |
| | compositions symbols | main phase | second phase | average of area ratio A(ave) % | standard deviations | s/A(ave) | rate of nano grains % | average grain sizes dL (micro grains) | average grain sizes ds (nano grains) | dL/ds |
| | standard | F | P, M, B, A, C | 3~30 | | ≦0.60 | | | | ≧3.0 |
| comparative example 1 | invented slab 6 | F | C | 4.8 | 1.7 | 0.35 | 39 | 0.42 | 1.64 | 3.9 |
| comparative example 2 | invented slab 4 | F | C | 4.6 | 2.2 | 0.48 | 28 | 0.44 | 2.87 | 6.5 |
| comparative example 3 | invented slab 2 | F | M | 38.6 | 22.6 | 0.59 | 18 | 0.90 | 3.50 | 3.9 |
| comparative example 4 | invented slab 2 | F | C | 3.5 | 1.8 | 0.51 | 100 | 0.43 | 1.47 | 3.4 |
| comparative example 5 | invented slab 3 | F | C | 4.4 | 3.2 | 0.73 | 2 | 0.89 | 3.86 | 4.3 |
| comparative example 6 | invented slab 3 | F | C | 5.2 | 4.3 | 0.83 | 0 | — | 6.78 | — |
| comparative example 7 | invented slab 11 | F | C | 8.8 | 3.8 | 0.43 | 91 | 0.70 | 1.52 | 2.2 |
| comparative example 8 | invented slab 11 | F | C | 7.2 | 3.8 | 0.53 | 63 | 0.54 | 1.44 | 2.6 |
| comparative example 9 | invented slab 11 | F | C | 7.3 | 6.9 | 0.95 | 52 | 0.65 | 1.88 | 2.9 |
| comparative example 10 | invented slab 11 | F | C | 6.6 | 4.5 | 0.68 | 49 | 0.72 | 1.92 | 2.7 |
| comparative example 11 | invented slab 5 | F | M | 28.4 | 21.2 | 0.75 | 11 | 0.73 | 1.89 | 2.6 |
| comparative example 12 | invented slab 5 | F | P | 23.6 | 18.9 | 0.80 | 0 | — | 4.60 | — |
| comparative example 13 | invented slab 6 | F | C | 4.6 | 2.5 | 0.54 | 5 | 0.51 | 1.92 | 3.8 |
| comparative example 14 | invented slab 6 | F | C | 4.9 | 1.9 | 0.39 | 11 | 0.50 | 1.87 | 3.7 |
| comparative example 15 | invented slab 18 | F | C | 4.3 | 2.2 | 0.51 | 3 | 0.78 | 3.34 | 4.3 |
| comparative example 16 | comparative slab 1 | F | C | 11.6 | 9.7 | 0.84 | 0 | — | 14.5 | — |
| comparative example 17 | comparative slab 2 | F | C | 16.6 | 25.4 | 1.53 | 0 | — | 12.3 | — |
| comparative example 18 | comparative slab 3 | F | P | 32.8 | 29.9 | 0.91 | 0 | — | 12.3 | — |
| comparative example 19 | comparative slab 4 | F | — | 0.0 | — | — | 0 | — | 8.70 | — |
| comparative example 20 | comparative slab 5 | F | — | 0.0 | — | — | 0 | — | 11.8 | — |
| comparative example 21 | comparative slab 6 | F | C | 2.4 | 1.1 | 0.46 | 0 | — | 9.5 | — |
| comparative example 22 | comparative slab 7 | F | C | 1.6 | 0.7 | 0.44 | 0 | — | 4.5 | — |

TABLE 6B-continued

| | | | | | | | | | | |
|---|---|---|---|---|---|---|---|---|---|---|
| comparative example 23 | comparative slab 8 | F | C | 3.7 | 1.3 | 0.35 | 25 | 0.55 | 2.53 | 4.6 |
| comparative example 24 | comparative slab 9 | F | C | 4.5 | 1.4 | 0.31 | 18 | 0.64 | 2.78 | 4.3 |
| comparative example 25 | comparative slab 10 | F | C | 3.3 | 1.8 | 0.55 | 19 | 0.49 | 1.46 | 3.0 |
| comparative example 26 | comparative slab 11 | F | C | 3.6 | 1.2 | 0.33 | 30 | 0.64 | 1.65 | 2.6 |

| | material properties | | | | | |
|---|---|---|---|---|---|---|
| | static TS MPa | static 3-5% deformation stress σs MPa | static elongation EI % | dynamic 3-5% deformation stress σd MPa | difference between static and dynamic stresses Δσ | absorption energy AE MJ/m$^3$ |
| | | | | | ≧170 | |
| comparative example 1 | 670 | 667 | 31 | 898 | 232 | 38.6 |
| comparative example 2 | 697 | 683 | 28 | 875 | 192 | 39.3 |
| comparative example 3 | 896 | 820 | 28 | 908 | 88 | 39.2 |
| comparative example 4 | 1255 | 1194 | 8 | 1292 | 99 | 55.0 |
| comparative example 5 | 525 | 479 | 31 | 578 | 99 | 25.1 |
| comparative example 6 | 522 | 487 | 29 | 577 | 90 | 24.8 |
| comparative example 7 | 938 | 884 | 12 | 976 | 92 | 39.9 |
| comparative example 8 | 812 | 788 | 15 | 858 | 70 | 33.8 |
| comparative example 9 | 674 | 563 | 22 | 646 | 83 | 31.0 |
| comparative example 10 | 796 | 789 | 16 | 853 | 64 | 35.2 |
| comparative example 11 | 656 | 575 | 33 | 658 | 83 | 28.3 |
| comparative example 12 | 550 | 468 | 35 | 605 | 137 | 27.1 |
| comparative example 13 | 789 | 754 | 5 | 862 | 108 | 39.9 |
| comparative example 14 | 714 | 681 | 14 | 823 | 142 | 35.6 |
| comparative example 15 | 589 | 544 | 26 | 637 | 93 | 27.0 |
| comparative example 16 | 436 | 413 | 39 | 518 | 105 | 23.5 |
| comparative example 17 | 563 | 535 | 24 | 609 | 74 | 26.0 |
| comparative example 18 | 560 | 532 | 22 | 605 | 73 | 26.0 |
| comparative example 19 | 500 | 412 | 32 | 521 | 109 | 24.1 |
| comparative example 20 | 346 | 318 | 44 | 502 | 184 | 22.3 |
| comparative example 21 | 378 | 342 | 39 | 501 | 159 | 21.9 |
| comparative example 22 | 639 | 625 | 22 | 711 | 86 | 27.8 |
| comparative example 23 | 906 | 879 | 15 | 996 | 117 | 41.2 |
| comparative example 24 | 693 | 656 | 22 | 784 | 128 | 32.4 |
| comparative example 25 | 773 | 754 | 20 | 855 | 101 | 33.5 |
| comparative example 26 | 891 | 882 | 14 | 954 | 72 | 39.8 |

P: pearlite
C: cementite
M: martensite
B: bainite
A: residual austenite

A cross section parallel to the rolling direction was cut out from each steel sheet of practical examples 3, 2, 11, and comparative example 1 and etched with 1% of nitric ethanol, so that structures thereof could be observed by SEM. These structures are shown in FIGS. 6 to 9.

Figure 6:
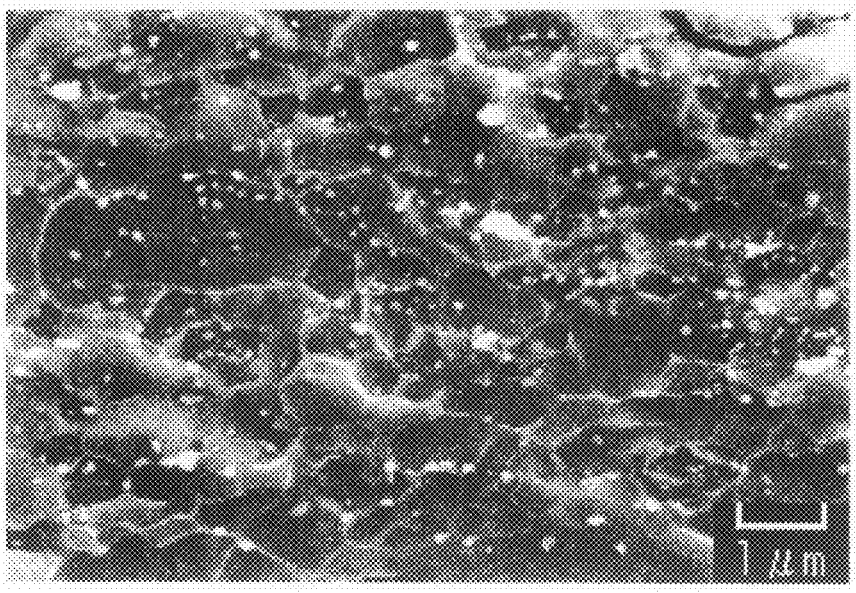
FIG. 6 is a SEM image showing a crystalline structure that has 88% of nanograins.
Figure 7:
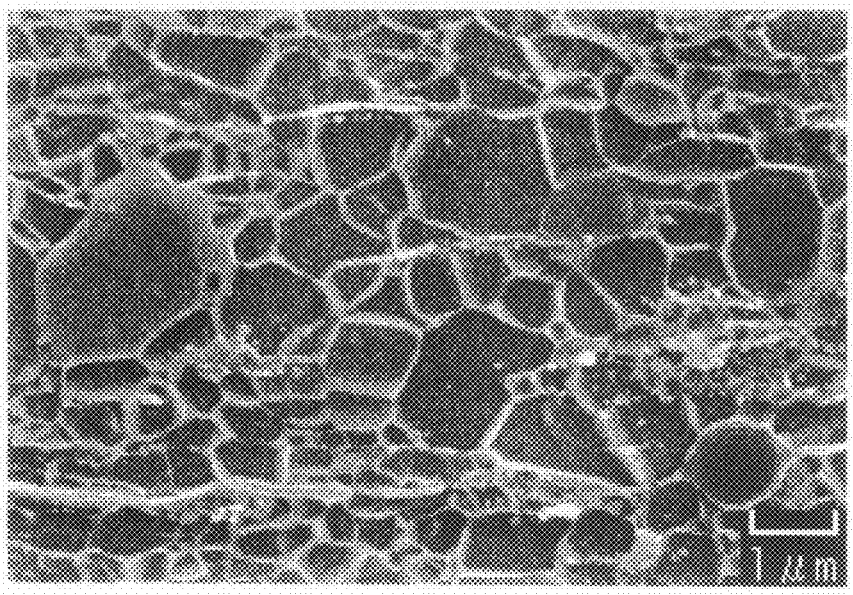
FIG. 7 is a SEM image showing a crystalline structure that has 79% of nanograins.
Figure 8:
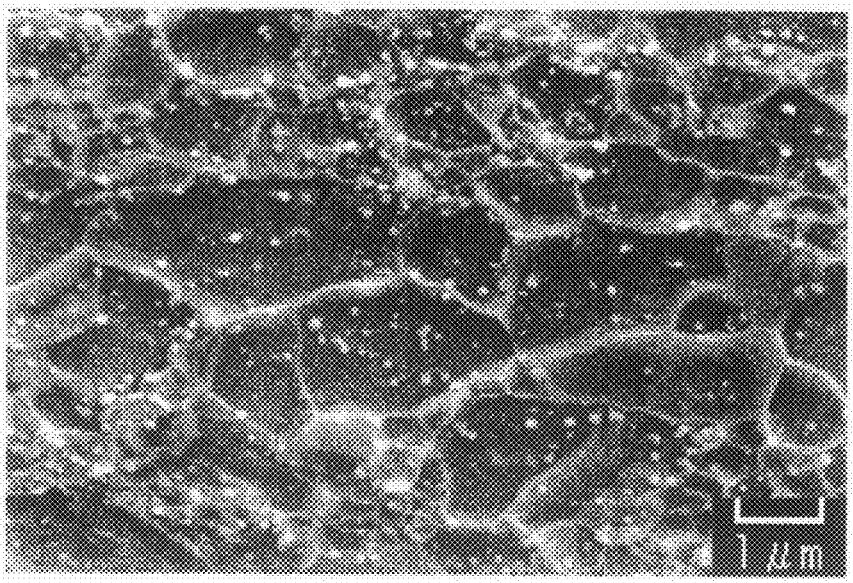
FIG. 8 is a SEM image showing a crystalline structure that has 39% of nanograins.
Figure 9:
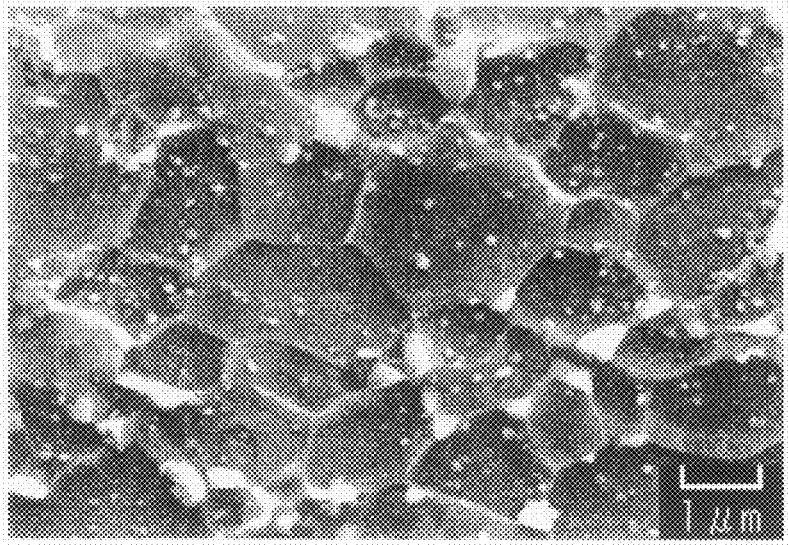
FIG. 9 is a SEM image showing a crystalline structure that has 15% of nanograins.

FIGS. 6, 7, and 8 show mixed structures comprising cementite as a hard second phase, and nanograins and micrograins as the rest. FIG. 9 shows a mixed structure comprising cementite and martensite as a hard second phase, and nanograins and micrograins as the rest.

Figure 10:
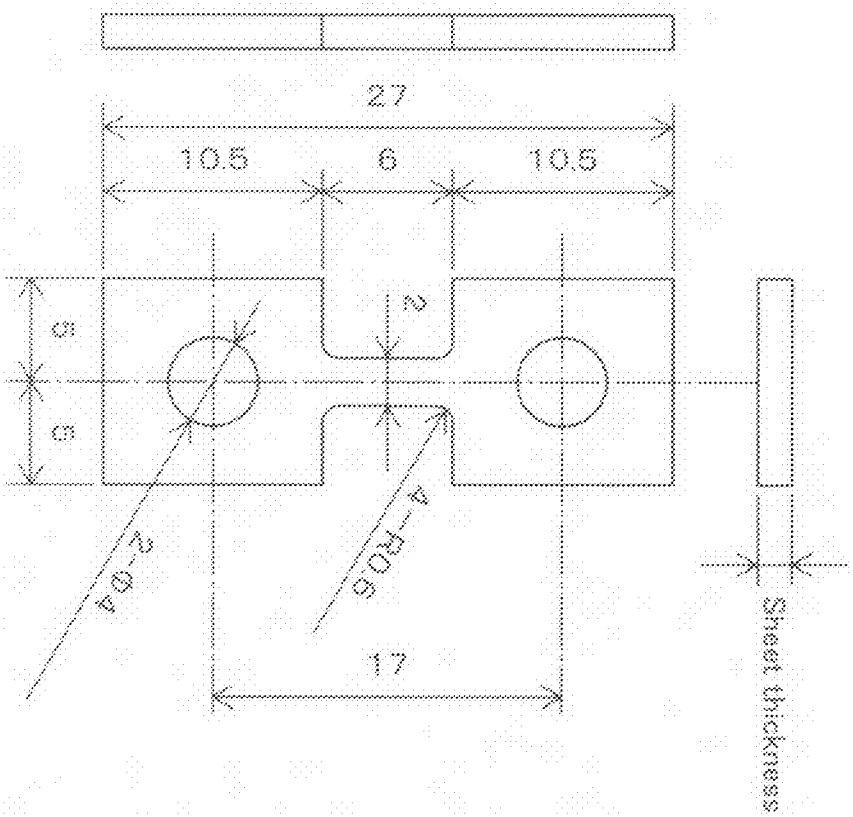
FIG. 10 is a diagram showing a test specimen that was used in a high speed tensile test.

Samples of which the shape is shown in FIG. 10 were cut out from each steel sheet to have a tension axis parallel to the rolling direction, and a tensile test was preformed. The tensile test was performed at 0.01/s and 1000/s of strain rate by high speed material testing machine TS-2000 manufactured by Saginomiya Seisakusyo, Inc. Properties such as a yield point, tensile strength, and absorption energy were determined by obtained nominal stress-nominal strain diagram. These results are described in Table 6.

Evaluation of Practical Examples 1 to 26

In practical examples 1 to 26, each steel sheet had superior properties of material, specifically, the difference of static and dynamic stresses was large (each of them was not less than 170 MPa). Therefore, the steel sheets of each practical example satisfied requirements for high strength of fast deformation, high absorption characteristics of impact energy, and high workability, and thereby could be used for automobile bodies.

Evaluation of Comparative Examples 1 to 26

In comparative examples 3 to 26, each steel had small difference in static and dynamic stresses (each of which was less than 170 MPa). Therefore, the steel sheets of the comparative examples 3 to 26 did not satisfy high strength requirements of fast deformation, high absorption characteristics of impact energy, and high workability, and thereby were undesirable for use in automobile bodies. The comparative examples 1 and 2 had 170 MPa or more of the difference of static and dynamic stresses, but had extremely high rolling rates in cold rolling, whereby they were undesirable for production because large amounts of load would have to be applied on the rolling machine.

Variations of the Present Invention

In the present invention, a hot dip galvanized steel sheet and a hot dip galvannealed steel sheet may be obtained by plating at annealing in addition to the above mentioned production method. A steel sheet may be iron plated in an electroplating line after hot dip galvanizing in order to improve corrosion resistance. Moreover, an electrogalvanized steel sheet and an electrogalvanized steel sheet with a Ni—Zn alloy may be obtained by plating in an electroplating line after annealing the steel of the present invention. Furthermore, organic coating treatment may be applied in order to improve corrosion resistance.

Figure 11:
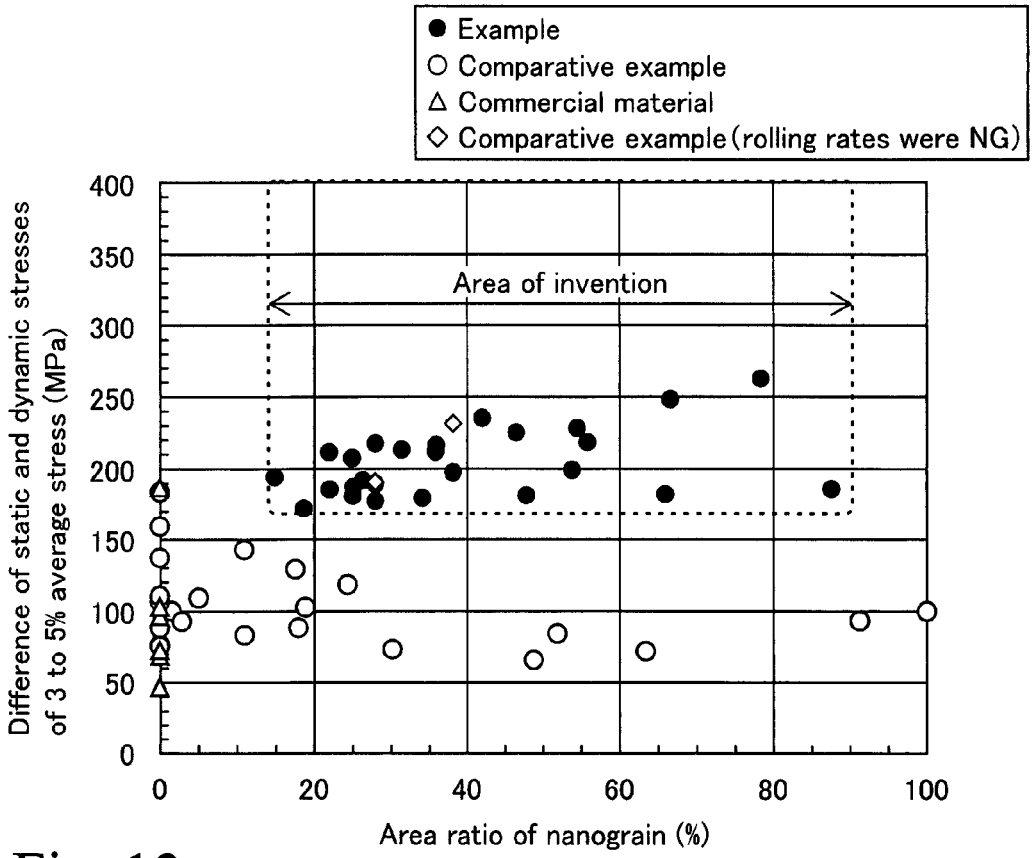
FIG. 11 is a graph showing a relationship between a difference of static and dynamic stresses of 3 to 5% of average stress and an area ratio of nanograins.

FIG. 11 is a graph showing the relationship between the difference in static and dynamic stresses of average stress of 3 to 5% strain and area ratio of nanograins. FIG. 11 shows that the difference of static and dynamic stresses increases when the above area ratio is in a range of 15 to 90%, and grounds for the value defined in claim 1 of the present invention were confirmed.

FIG. 11 shows data of commercial materials in addition to the practical examples and comparative examples. Material properties of the commercial materials are shown in Table 7.

TABLE 7

| | material standard (Japan Iron and Steel Federation) | sheet thickness mm | structure main phase | structure second phase | rate of nano grains % | material property static TS MPa | static stress σs MPa | static elongation EI % | dynamic stress σd MPa | difference of static and dynamic stresses Δσ MPa | absorption energy AE MJ/m³ |
|---|---|---|---|---|---|---|---|---|---|---|---|
| commercial material 1 | JSC270E | 1.0 | F | — | 0 | 317 | 273 | 45 | 461 | 188 | 21.6 |
| commercial material 2 | JSC440W | 1.0 | F | C | 0 | 462 | 427 | 36 | 524 | 97 | 23.9 |
| commercial material 3 | JSC440P | 0.9 | F | — | 0 | 447 | 407 | 38 | 510 | 103 | 23.0 |
| commercial material 4 | JSC590Y | 1.0 | F | M | 0 | 651 | 599 | 28 | 667 | 68 | 28.5 |
| commercial material 5 | JSC780Y | 1.6 | F | M | 0 | 842 | 794 | 24 | 840 | 46 | 36.4 |
| commercial material 6 | JSC980Y | 1.6 | F | M | 0 | 1099 | 1090 | 16 | 1162 | 72 | 49.8 |

F: ferrite
M: martensite
C: cementite

According to Table 7, each commercial material 1 to 6 had a smaller difference of static and dynamic stresses than that of each practical example shown in Table 6. Therefore, steel sheets of each practical example were found to have an extremely high degree of strength of fast deformation, absorption characteristics of impact energy, and workability compared with those of conventional commercial materials.

Figure 12:
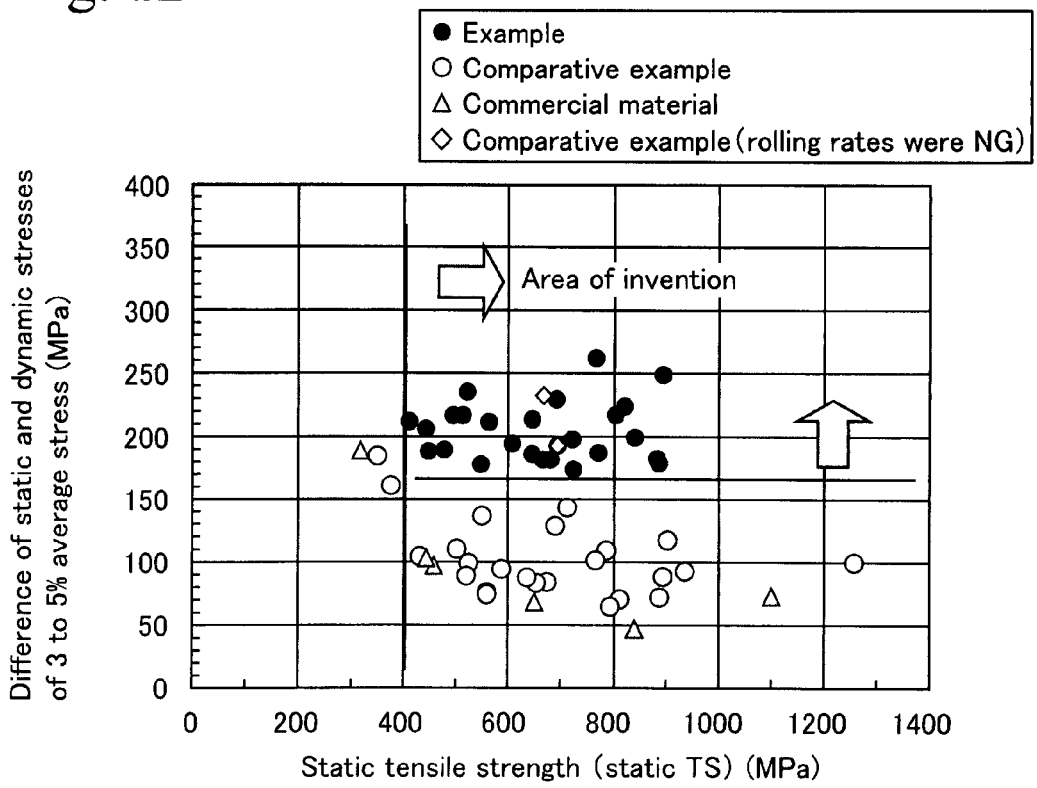
FIG. 12 is a graph showing a relationship between a difference of static and dynamic of 3 to 5% strain of average stress and a static tensile strength (static TS).

FIG. 12 is a graph showing the relationship between the difference in static and dynamic stresses of average stress of 3 to 5% strain and static tensile strength (static TS). According to FIG. 12, each practical example was found to have higher absorption energy than those of other examples.

Figure 13:
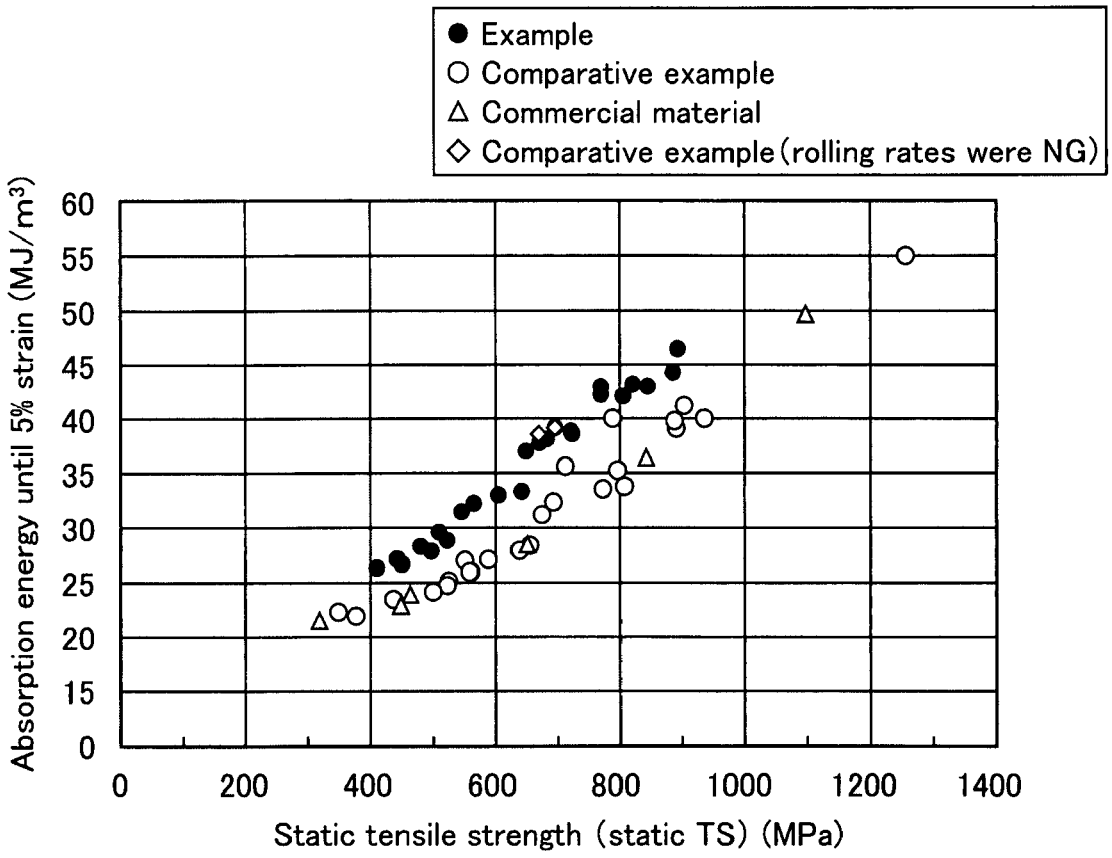
FIG. 13 is a graph showing a relationship between a dynamic absorption energy until 5% strain and a static tensile strength (static TS).

FIG. 13 is a graph showing the relationship between absorption energy until 5% strain and static tensile strength (static TS). According to FIG. 13, each practical example was found to have higher absorption energy than those of other examples. The absorption energy thereof was at the same degree as those of the comparative examples which had higher static TS than those of the practical examples by about 200 MPa.

INDUSTRIAL APPLICABILITY

According to the present invention, a high-strength steel sheet is provided. For example, a high-strength steel sheet has press formability at the same degree as that of a steel sheet which has 600 MPa of tensile strength, and has superior characteristics of energy absorption of impacts at the same degree as that of a steel sheet which has 800 MPa of tensile strength by increasing the tensile strength at crash deformation after being formed into a part. Therefore, the present invention has an advantage being usable in automobile bodies that require high strength of fast deformation, superior characteristics of energy absorption of impact, and high workability.

The invention claimed is:

1. A high-strength steel sheet comprising:

a metal structure consisting of a ferrite phase and a hard second phase dispersed in the ferrite phase;

the hard second phase in the metal structure having an area ratio of 3 to 30%; and the ferrite phase is divided into first grains with a grain size not more than 1.2 μm and second grains with a grain size more than 1.2 μm, wherein the area ratio of first grains is 15 to 90%; and wherein dS as an average grain size of the first grains, and dL as an average grain size of the second grains, satisfy the following equation (1):

$$dL/dS \geqq 3 \quad (1).$$

2. The high-strength steel sheet according to claim 1, wherein A(ave) as an average of Ai (i=1, 2, 3, . . . ) which is an area ratio of hard second phases at each lattice, and standard deviation s, satisfy the following equation (2) when not fewer than 9 pieces of lattice of 3 μm square are optionally chosen in a cross section which is parallel to a rolling direction of the steel sheet:

$$s/A(\text{ave}) \leqq 0.6 \quad (2).$$

3. The high-strength steel sheet according to claim 1, wherein the steel sheet comprises C and at least one selected from a group consisting of Si, Mn, Cr, Mo, Ni and B, and C (amount of solid-solved carbon calculated by subtracting amount of carbon combined with Nb and Ti from total amount of carbon) satisfies the following equations (4), (5), and (6) on the basis of the following equation (3):

$$F_1(Q)=0.65\text{Si}+3.1\text{Mn}+2\text{Cr}+2.3\text{Mo}+0.3\text{Ni}+2000\text{B} \quad (3)$$

$$F_1(Q) \geqq -40\text{C}+6 \quad (4)$$

$$F_1(Q) \geqq 25\text{C}-2.5 \quad (5)$$

$$0.02 \leqq \text{C} \leqq 0.3 \quad (6)$$

wherein, component ratios (mass %) of the additive elements are substituted for each of the additive elements in equation (3).

4. The high-strength steel sheet according to claim 3, wherein compositions thereof satisfy the following equation (9) on the basis of the following equations (7) and (8):

$$F_2(S)=112\text{Si}+98\text{Mn}+218\text{P}+317\text{Al}+9\text{Cr}+56\text{Mo}+8\text{Ni}+1417\text{B} \quad (7)$$

$$F_3(P)=500\times\text{Nb}+1000\times\text{Ti} \quad (8)$$

$$F_2(S)+F_3(P) \leqq 360 \quad (9)$$

wherein, component ratios (mass %) of the additive elements are substituted for each of the additive elements in equations (7) and (8).

5. The high-strength steel sheet according to claim 3, wherein the steel sheet comprises at least one of not more than 0.72 mass % of Nb and not more than 0.36 mass % of Ti.

6. The high-strength steel sheet according to claim 4, wherein the steel sheet comprises at least one of not more than 2 mass % of P and not more than 18 mass % of Al.

7. The high-strength steel sheet according to claim 3, wherein the steel sheet comprises not more than 5 mass % of Si, not more than 3.5 mass % of Mn, not more than 1.5 mass % of Cr, not more than 0.7 mass % of Mo, not more than 10 mass % of Ni, and not more than 0.003 mass % of B.

8. A production method for the high-strength steel sheet according to claim 1 to 7, the method comprising:

cold rolling a hot-rolled steel sheet consisting of a metal structure of a ferrite phase and a hard second phase in a condition in which reduction index D satisfies the following equation (10); and annealing the hot-rolled steel sheet in a condition satisfying the following equation (11):

$$D=d\times t/t_0 \leqq 1 \quad (10)$$

(d: average distance between the hard second phases (μm), t: sheet thickness after cold rolling, $t_0$: sheet thickness between after hot rolling and before cold rolling)

$$680<-40\times\log(ts)+Ts<770 \quad (11)$$

(ts: maintaining time (sec), Ts: maintaining temperature (° C.), log (ts) is the common logarithm of ts).

9. The production method for the high-strength steel sheet according to claim 8, wherein an average distance between the hard second phases is not more than 5 μm in a direction of a sheet thickness of the hot-rolled steel sheet.

* * * * *